US009315953B2

(12) United States Patent
White

(10) Patent No.: US 9,315,953 B2
(45) Date of Patent: Apr. 19, 2016

(54) THREE-DIMENSIONAL AGGREGATE REINFORCEMENT SYSTEMS AND METHODS

(71) Applicant: David J. White, Boone, IA (US)

(72) Inventor: David J. White, Boone, IA (US)

(73) Assignee: Ingios Geotechnics, Inc., Boone, IA (US)

( * ) Notice: Subject to any disclaimer, the term of this patent is extended or adjusted under 35 U.S.C. 154(b) by 0 days.

(21) Appl. No.: 14/592,879

(22) Filed: Jan. 8, 2015

(65) Prior Publication Data

US 2015/0191878 A1 Jul. 9, 2015

Related U.S. Application Data

(60) Provisional application No. 61/925,298, filed on Jan. 9, 2014.

(51) Int. Cl.

| | |
|---|---|
| ***E01C 11/00*** | (2006.01) |
| ***E01C 11/16*** | (2006.01) |
| ***E01C 3/00*** | (2006.01) |
| ***E01C 3/06*** | (2006.01) |

(52) U.S. Cl.
CPC ..... *E01C 11/16* (2013.01); *E01C 3/006* (2013.01); *E01C 3/06* (2013.01)

(58) Field of Classification Search
CPC ..... E01C 3/006; E01C 3/06; E01C 11/16
USPC ..... 404/43, 27, 31, 28, 73, 75
See application file for complete search history.

(56) References Cited

U.S. PATENT DOCUMENTS 3,552,277 A * 1/1971 Avital ..... A47C 27/20 404/31
5,044,821 A * 9/1991 Johnsen ..... E02D 31/02 405/50

(Continued)

FOREIGN PATENT DOCUMENTS

WO 98/43800 A1 10/1998

OTHER PUBLICATIONS

PCT Search Report and Written Opinion dated May 14, 2015 for PCT Application PCT/US2015/010706.

*Primary Examiner* — Raymond W Addie
(74) *Attorney, Agent, or Firm* — Olive Law Group, PLLC

(57) ABSTRACT

Three-dimensional aggregate reinforcement systems and methods thereof stiffen aggregate layers, such as those used for pavement construction. The system may include a substantially planar grid connected to a plurality of projections that extend into a third out-of-plane dimension. The system may be a self-projecting three-dimensional aggregate reinforcement system including a substantially planar grid which is generally two-dimensional before use, and which project into the third out-of-plane dimension after compaction with aggregate. The system may also be a self-projecting three-dimensional aggregate reinforcement system including a substantially planar grid with a plurality of first and second movable portions, where the second movable portions are more flexible than the first portion and may extend vertically and laterally upon addition of aggregate. Further, a method may include positioning a three-dimensional aggregate reinforcement system on the ground, adding aggregate to the aggregate reinforcement system, and compacting the aggregate.

20 Claims, 28 Drawing Sheets

(56) References Cited

U.S. PATENT DOCUMENTS 5,383,314 A * 1/1995 Rothberg ..... E02D 31/02 405/43
6,616,542 B1 * 9/2003 Reddick ..... A63B 69/3661 428/17
6,802,669 B2 * 10/2004 Ianniello ..... E01F 5/00 404/28
7,131,788 B2 * 11/2006 Ianniello ..... E01C 3/00 404/28
7,587,865 B2 * 9/2009 Moller, Jr. ..... E01C 5/20 52/177
8,696,241 B2 * 4/2014 Lee ..... E01C 13/083 404/36
9,103,076 B2 * 8/2015 Hassan ..... E01C 13/00
2004/0022580 A1 * 2/2004 Dennison ..... E01C 11/165 404/34
2008/0113161 A1 * 5/2008 Grimble ..... B27N 5/00 428/174
2009/0188172 A1 * 7/2009 DuCharme ..... E04D 13/0477 52/11
2009/0208674 A1 * 8/2009 Murphy ..... A01G 1/002 428/17
2013/0129417 A1 * 5/2013 Sawyer ..... E01C 11/225 404/4

* cited by examiner $$\delta = \frac{5qL^4}{384\,EI}$$

$E_{composite}$ $$I_{composite} = [I_{rib} + A_{rib}(\bar{y} - y_1)] + [I_{g+a} + A_{g+a}(y_2 - \bar{y})]$$

$$I_{g+a} = \frac{w_g h_g^3}{12}$$

$$I_{rib} = \frac{w_r h_r^3}{12}$$

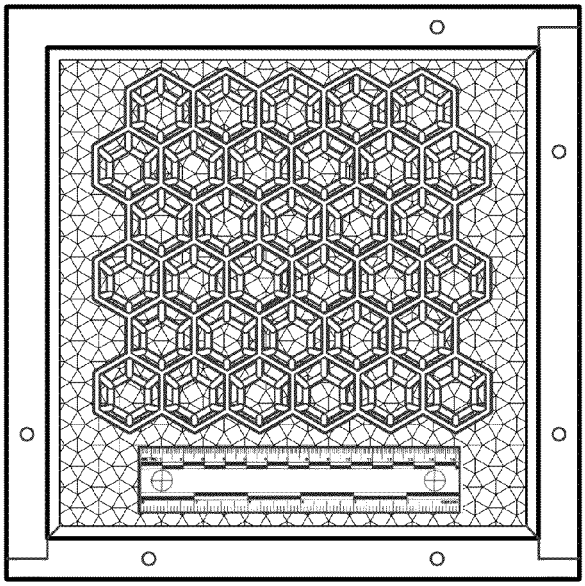
FIG. 20A
FIG. 20B
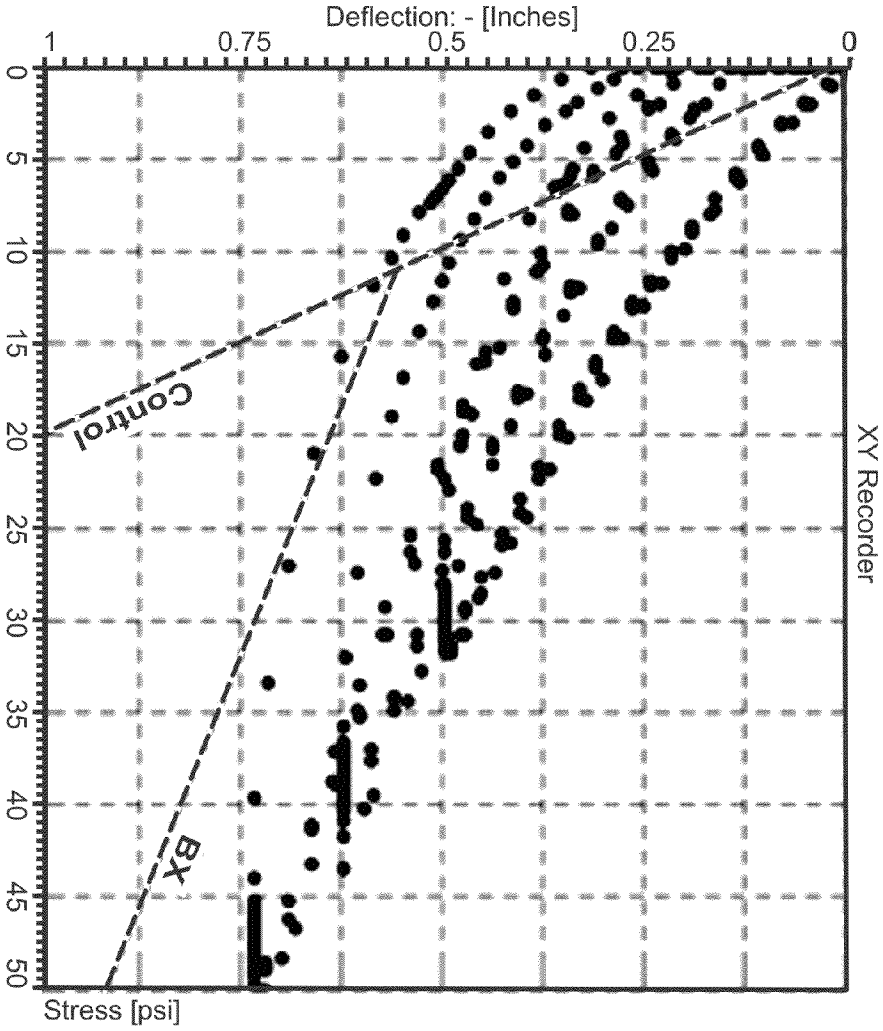

THREE-DIMENSIONAL AGGREGATE REINFORCEMENT SYSTEMS AND METHODS

CROSS REFERENCE TO RELATED APPLICATION

This application claims the benefit of and priority to U.S. Provisional Patent Application No. 61/925,298, filed Jan. 9, 2014, and titled THREE-DIMENSIONAL AGGREGATE REINFORCEMENT SYSTEMS AND METHODS; the entire disclosure of which is incorporated herein in its entirety.

BACKGROUND

1. Technical Field

The present subject matter relates to reinforcement systems. Particularly, the present subject matter relates to three-dimensional aggregate reinforcement systems and methods.

2. Description of Related Art

Pavements that are used to facilitate vehicle traffic typically include a surface layer of asphaltic concrete or Portland cement concrete overlying a sub-layer of base course aggregate overlying natural or stabilized subgrade. The thickness of the layers of the pavement materials can depend upon the desired design life, the applied vehicle loading, and the stiffness of each of the components. For a given traffic loading condition, thinner layers of the materials with stiffer material properties may be used to replace thicker layers of materials with softer properties. In conventional construction, stiffness of the pavement sub-layers may sometimes be enhanced by adding binding or chemically modifying materials such as cement, lime, fly ash, or combinations of these materials, by incorporating layers of geosynthetic materials such as geogrids or geotextiles within the pavement layers, and by replacing the weak subgrade materials with a thick aggregate layer.

Geogrids have been developed to reinforce soils, pavement systems, and similar materials. They are currently used in some pavement sections to stabilize the subgrade materials and to enhance the performance of base course materials. Geogrids are commonly made of polymer materials, such as polyester, polyethylene, or polypropylene. A particular type of geogrrid is a biaxial (BX) polymeric geogrid. The term "biaxial" refers to the provision of two sets of continuous ribs through each node (i.e., connection points at rib intersections). Triaxial geogrids, which have three sets of continuous ribs through each node and provide increased nodal and system stability, are also used. Although current geogrids enhance the stiffness of the aggregate layer, it is desired to provide systems having a greater amount of layer composite stiffness. More generally, there is a continuing need for improved reinforcement systems and techniques.

BRIEF SUMMARY

The presently disclosed subject matter relates generally to the incorporation of three-dimensional composite reinforcement systems within aggregate layers to stiffen the aggregate layers that will be presented in the following simplified summary to provide a basic understanding of one or more aspects of the disclosure. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

In accordance with embodiments, disclosed herein are structures and methods to improve composite stiffness of aggregate layers. For example, the improved stiffness of aggregate layers can be used over soft subgrade for pavement systems and other earthwork fill systems. The presently disclosed structures and methods allow for improved performance of the pavement and a reduction in the thickness of pavement layers.

The presently disclosed subject matter may provide control of intelligent compaction measurement values by rapidly deploying and embedding products in the ground.

In accordance with embodiments, disclosed herein is a three-dimensional aggregate reinforcement system including a grid structure that substantially extends along a plane; and a plurality of projections that each comprise at least one end attached to the grid structure and another end that extends in a direction away from the plane.

In other embodiments, the presently disclosed subject matter provides a self-projecting three-dimensional aggregate reinforcement system comprising a substantially planar grid which is generally two-dimensional before use. Multiple projections extend in a direction away from the plane in response to compaction with aggregate.

In other embodiments, the presently disclosed subject matter provides a self-projecting three-dimensional aggregate reinforcement system comprising a substantially planar grid with a plurality of first movable portions and second movable portions. The second moveable portions are more flexible than that of the first moveable portions such that addition of aggregate to the grid structure results in the projection of laterally constrained aggregate at the second moveable portions in a direction away from the plane, such as into the third out-of-plane dimension.

In accordance with other embodiments, a method for improving the stiffness of aggregate is provided. The method may include the step of positioning the reinforcement system as disclosed above on the ground. The method may also include adding aggregate to the reinforcement system; and compacting the aggregate.

In accordance with yet other embodiments, a method of strengthening and stiffening a particulate material is provided. The method may include the step of positioning the reinforcement system disclosed above on the ground. The method may also include adding aggregate to the reinforcement system; and compacting the aggregate.

Certain aspects of the presently disclosed subject matter having been stated hereinabove, which are addressed in whole or in part by the presently disclosed subject matter, other aspects will become evident as the description proceeds when taken in connection with the accompanying Examples and Figures as best described herein below.

BRIEF DESCRIPTION OF THE SEVERAL VIEWS OF THE DRAWINGS

Figure 1:
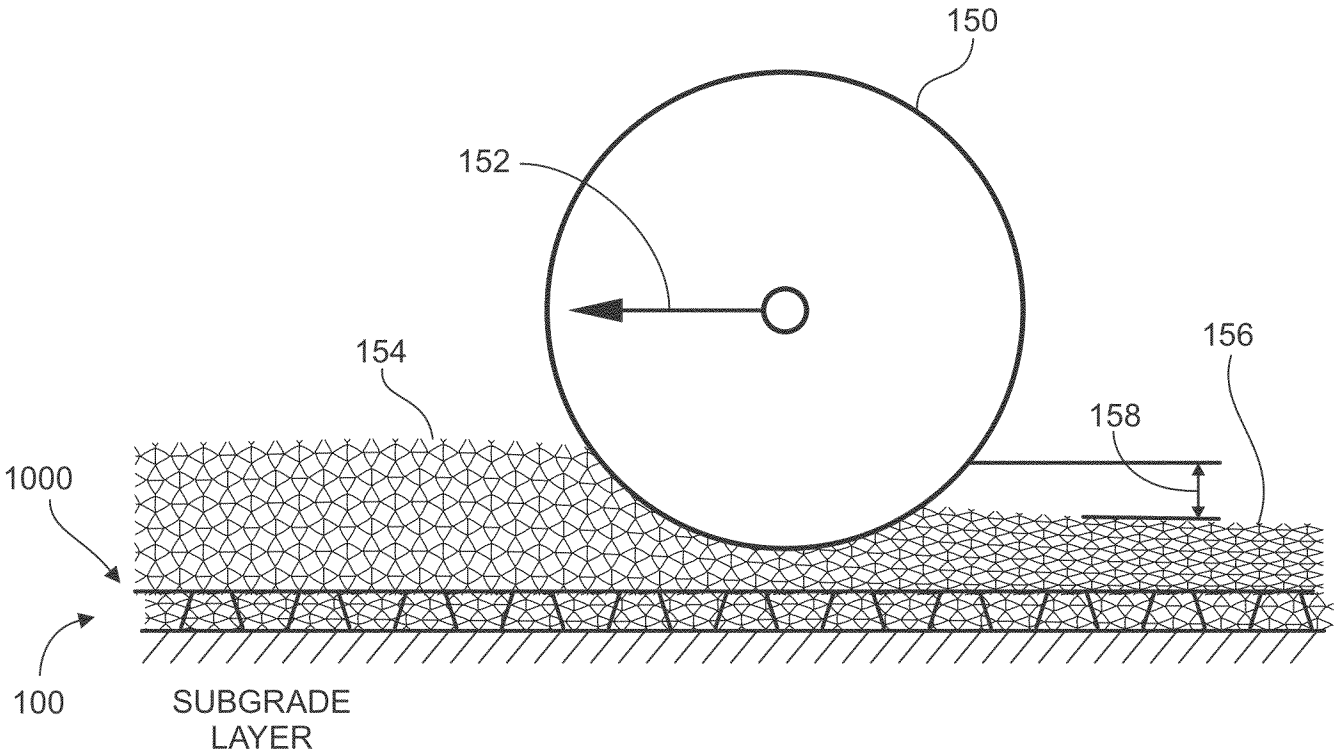
Figure 2A:
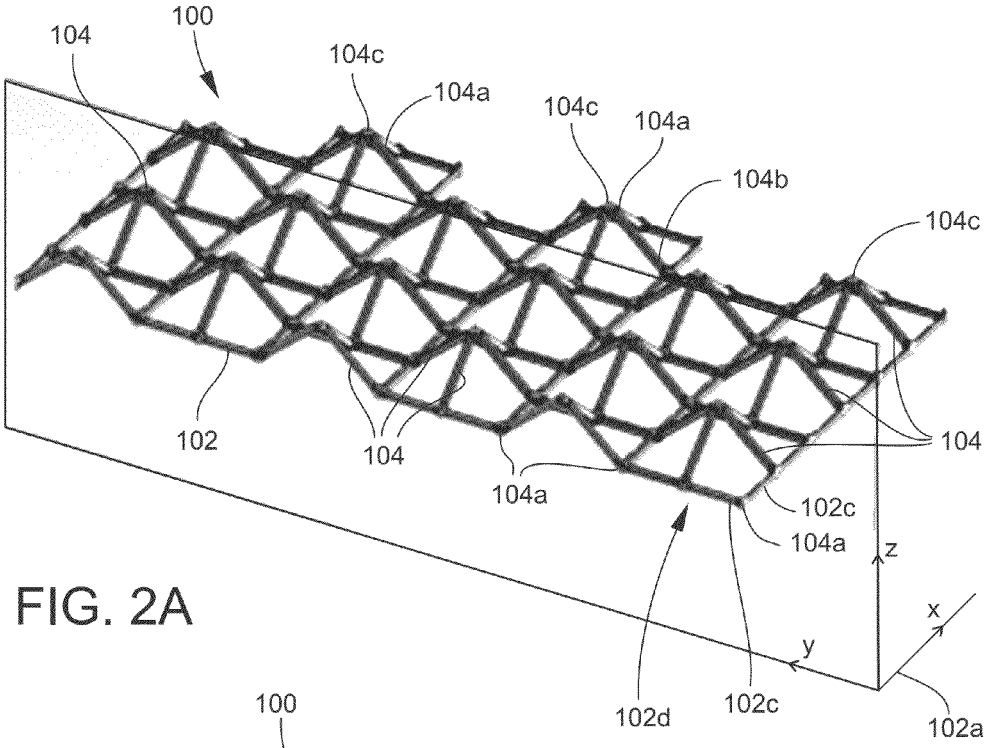
Figure 2B:
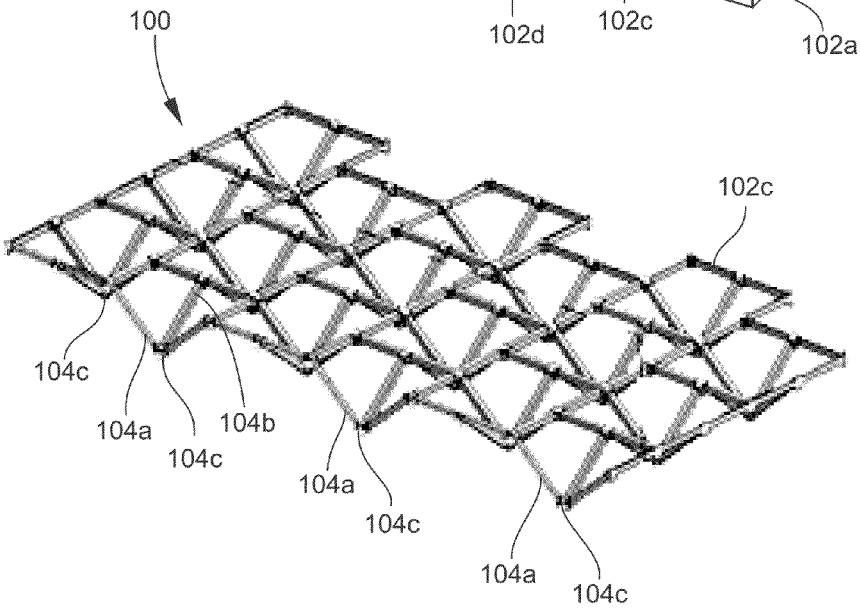
Figure 3A:
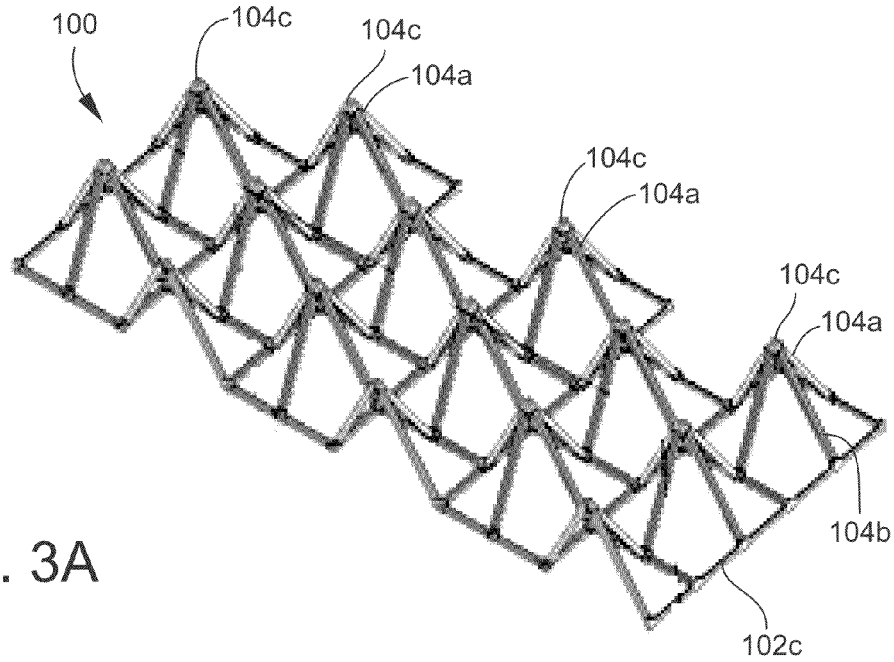
Figure 3B:
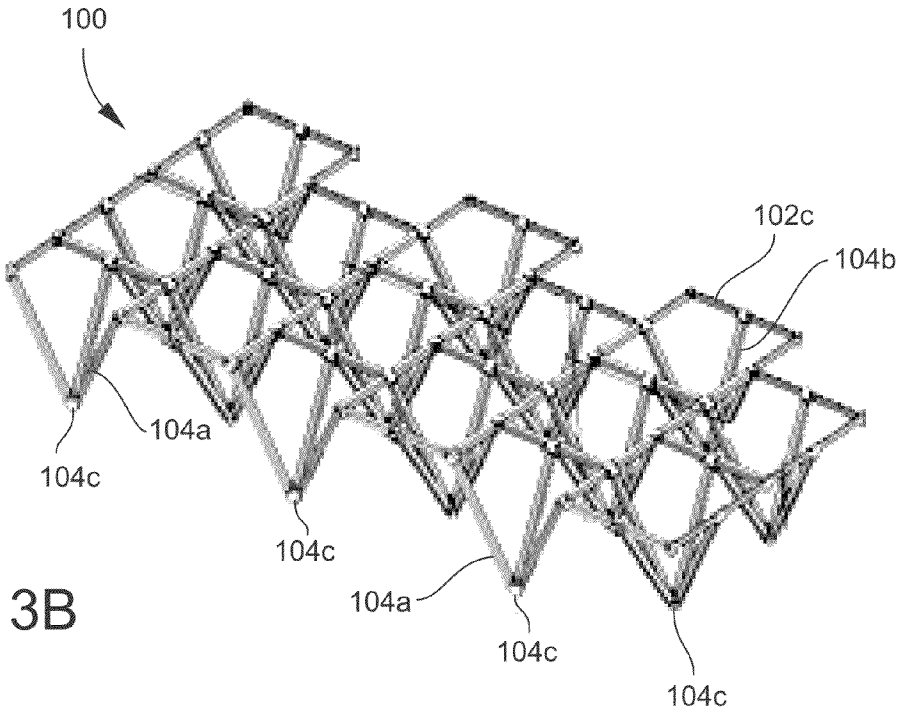
Figure 4A:
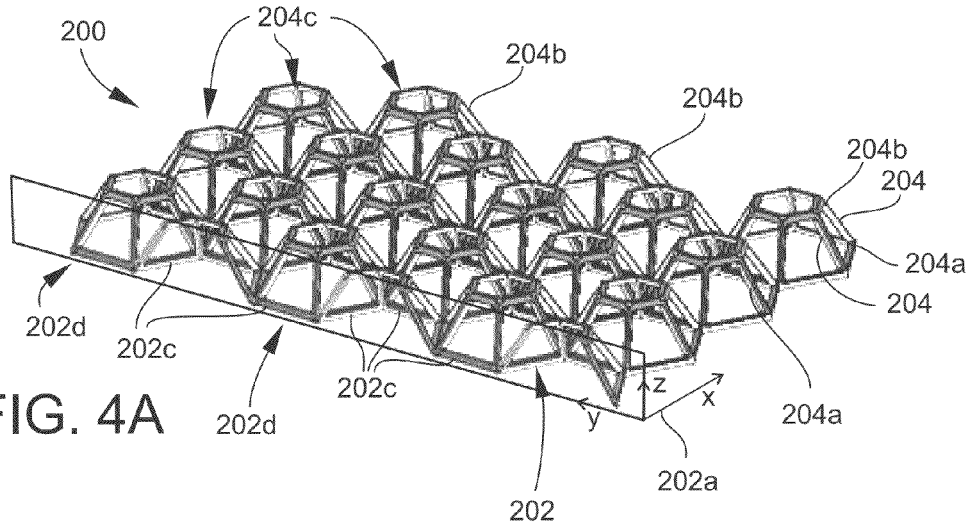
Figure 4B:
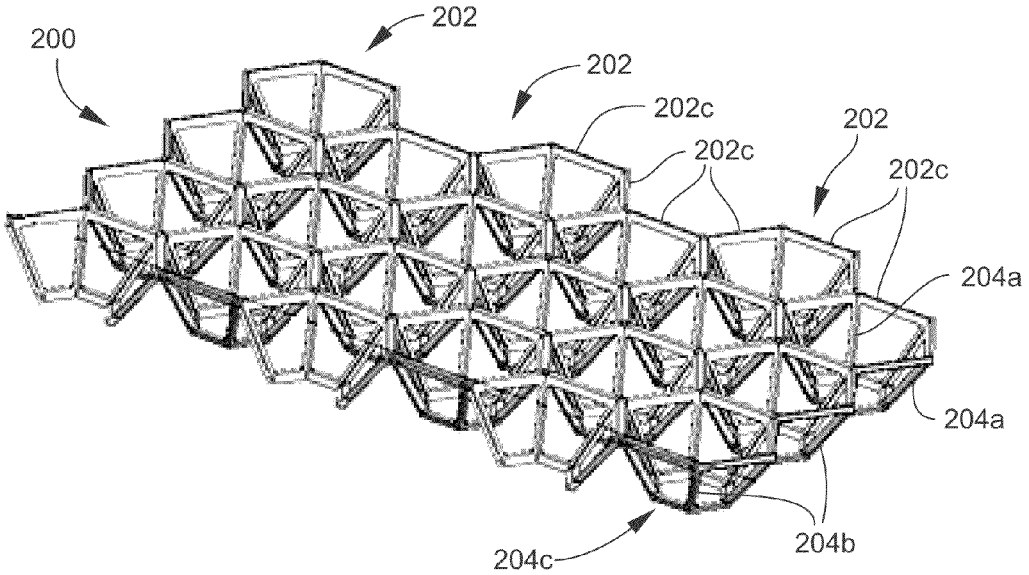
Figure 5A:
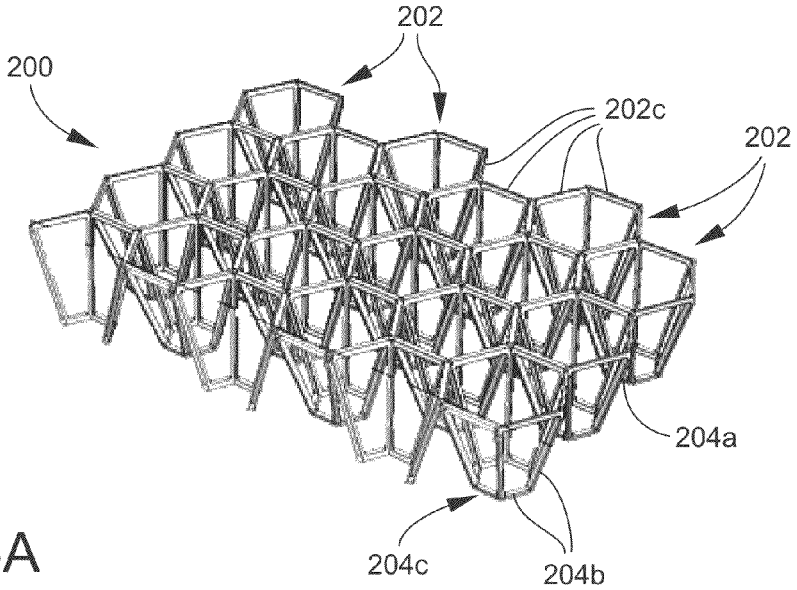
Figure 5B:
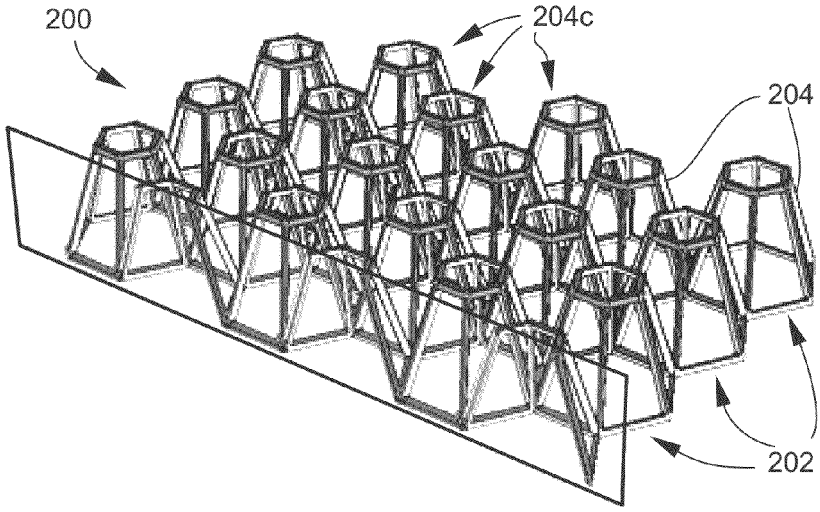
Figure 6:
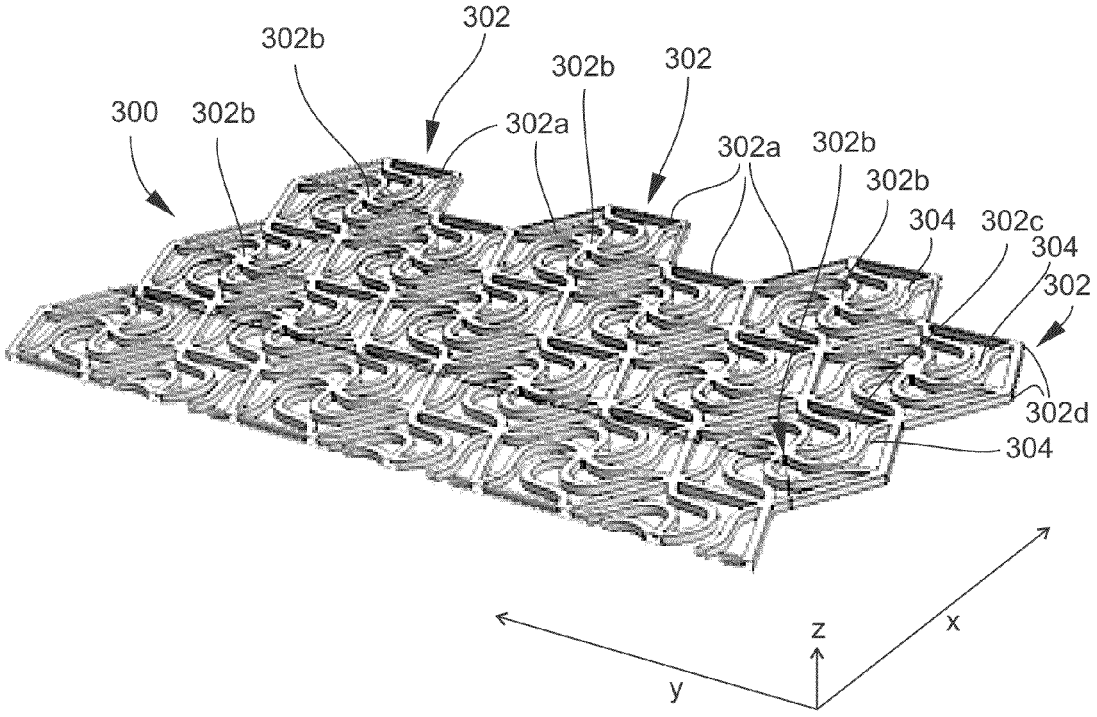
Figure 7A:
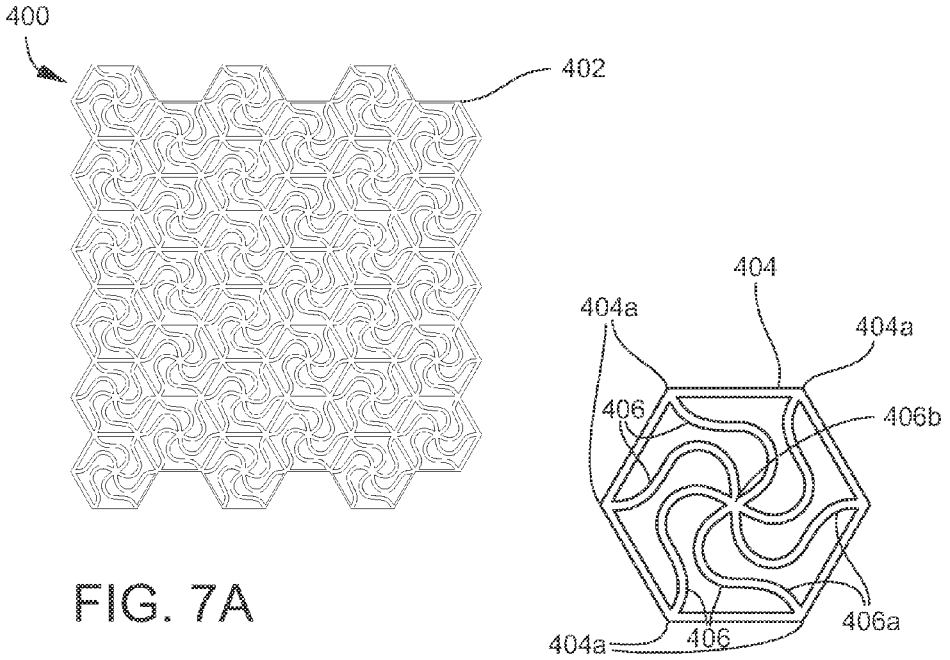
Figure 7B:
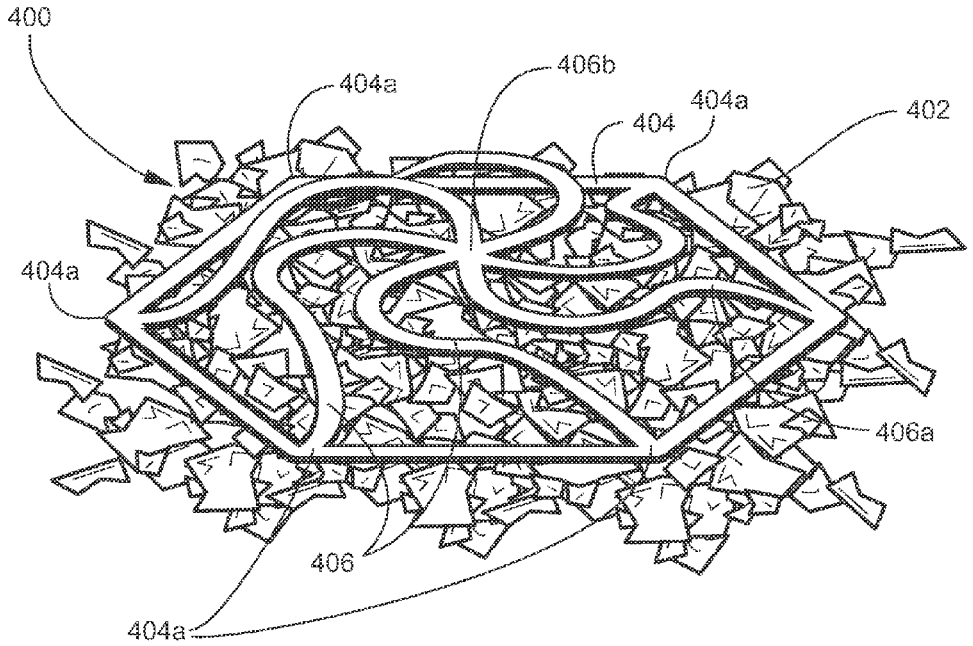
Figure 8A:
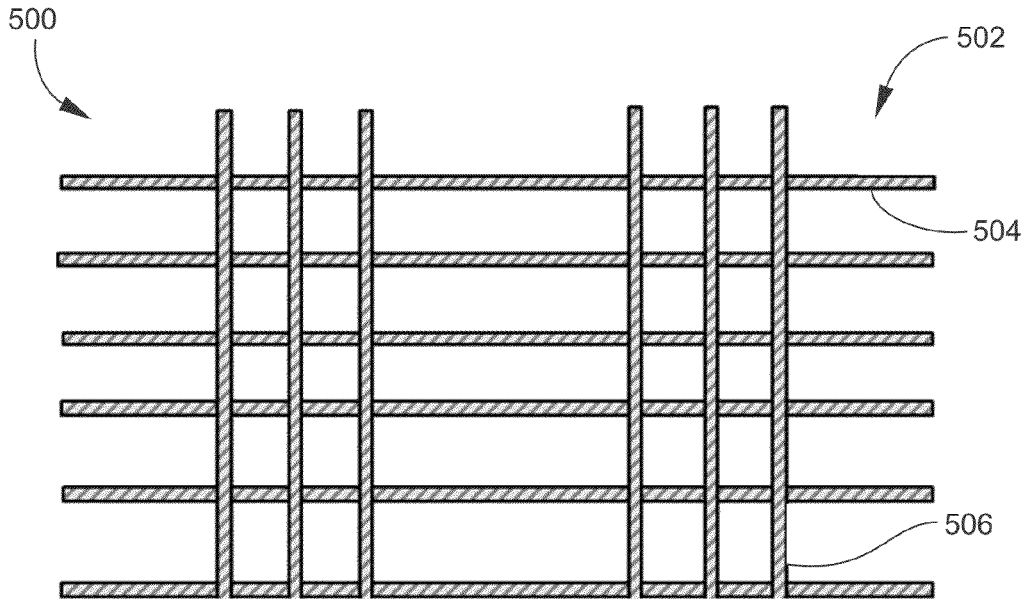
Figure 8B:
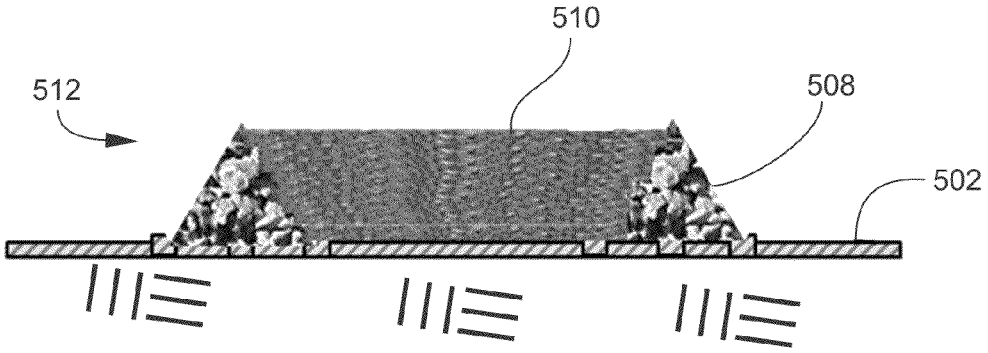
Figure 9A:
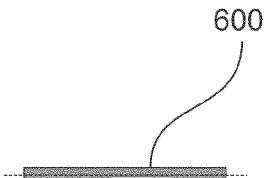
Figure 9B:
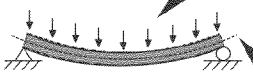
Figure 9C:
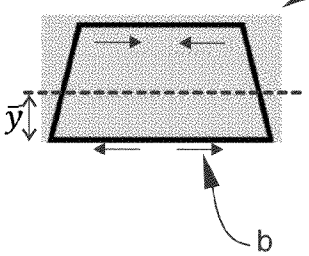
Figure 9C:
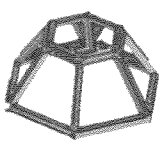
Figure 11A:
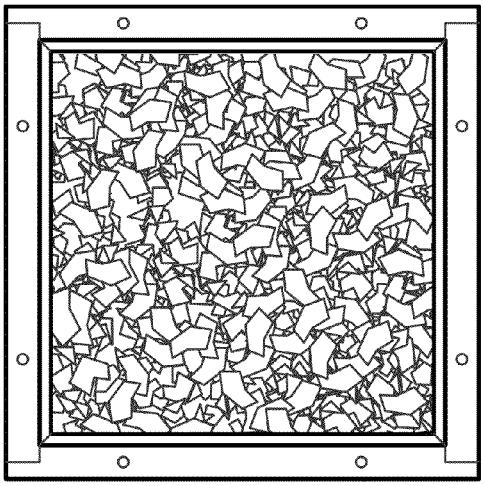
Figure 11B:
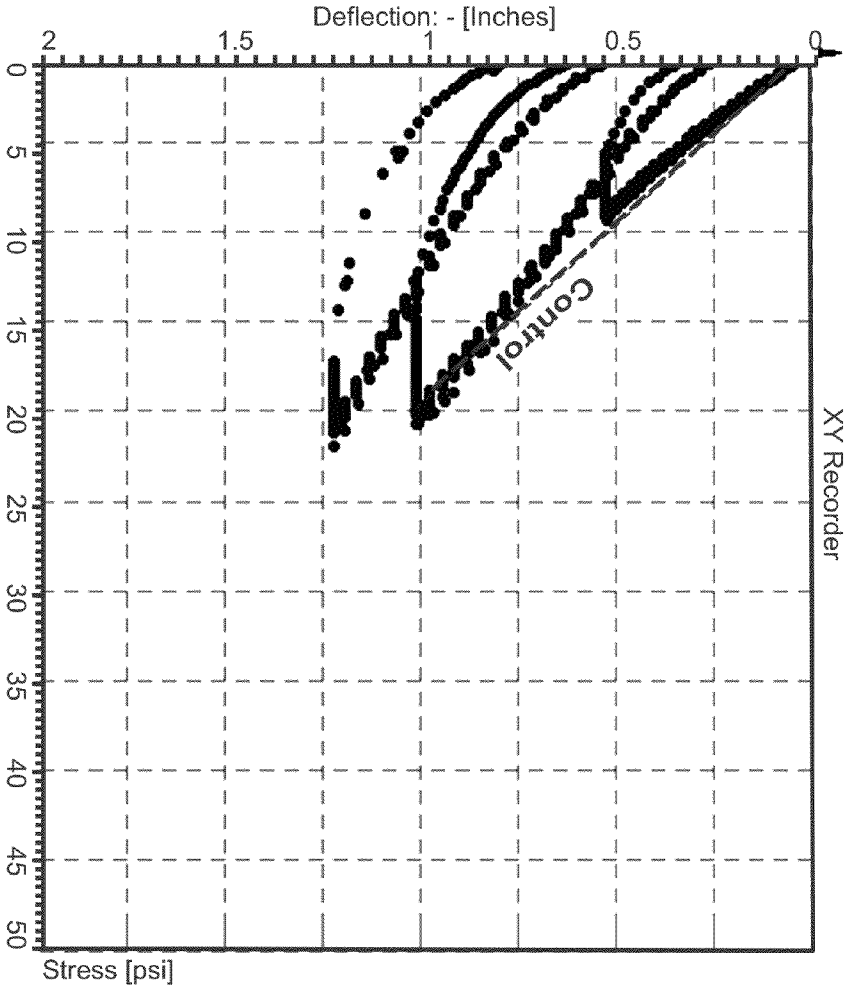
Figure 12A:
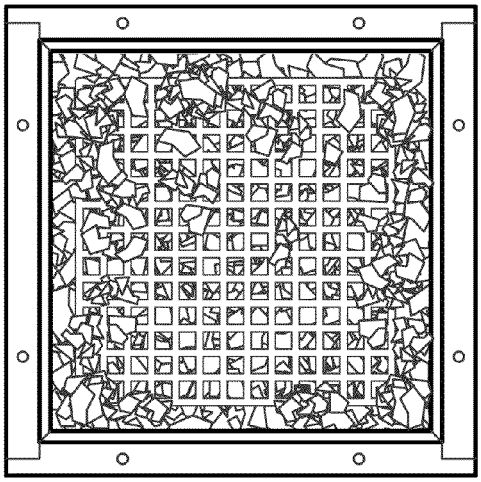
Figure 12B:
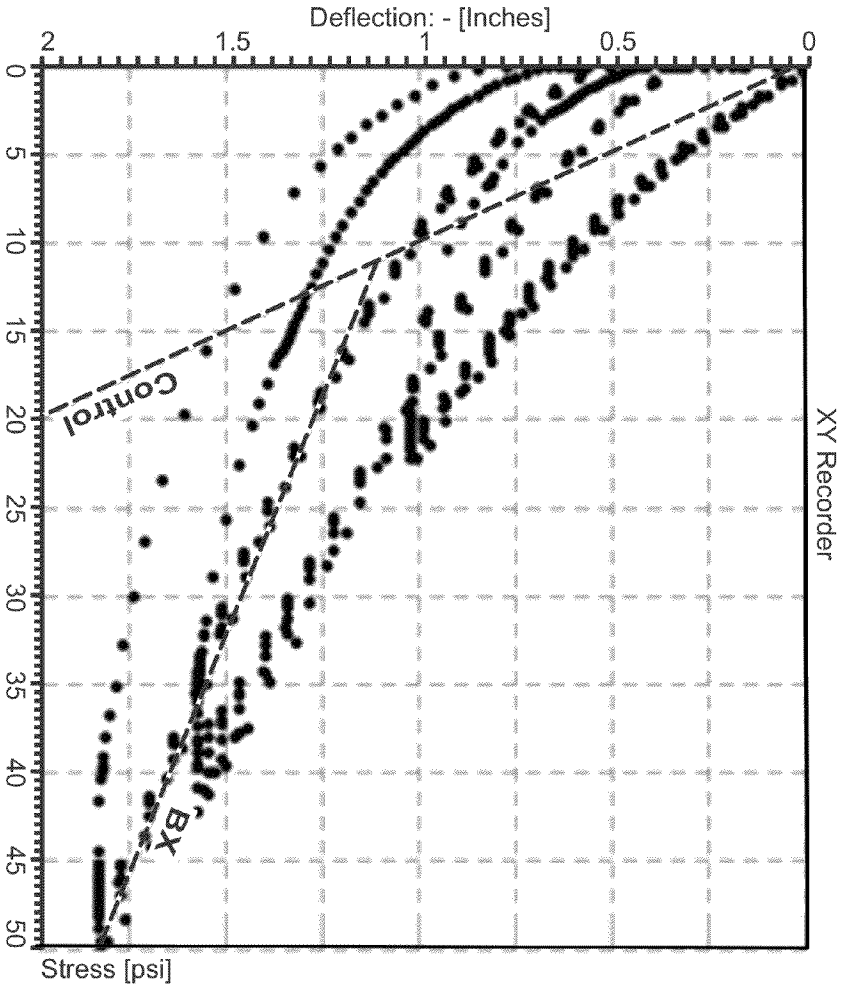
Figure 13A:
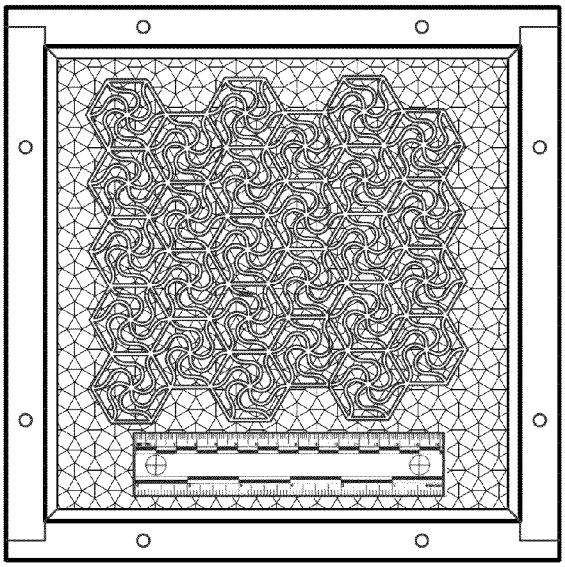
Figure 13B:
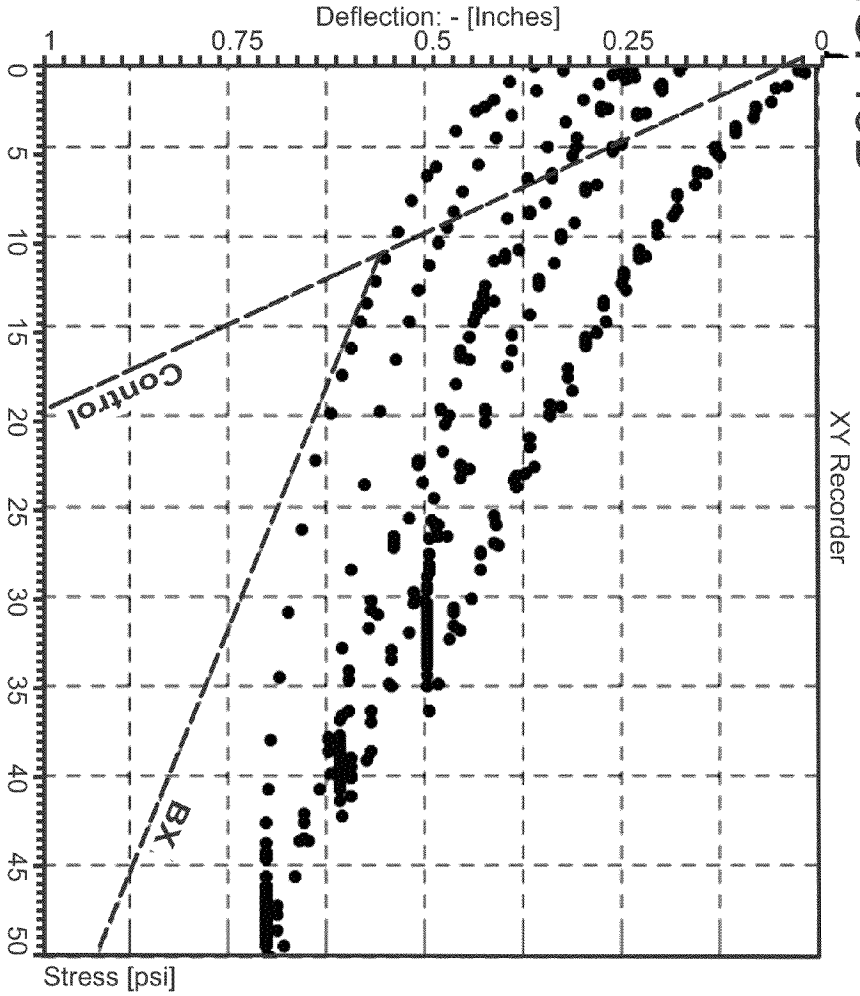
Figure 14A:
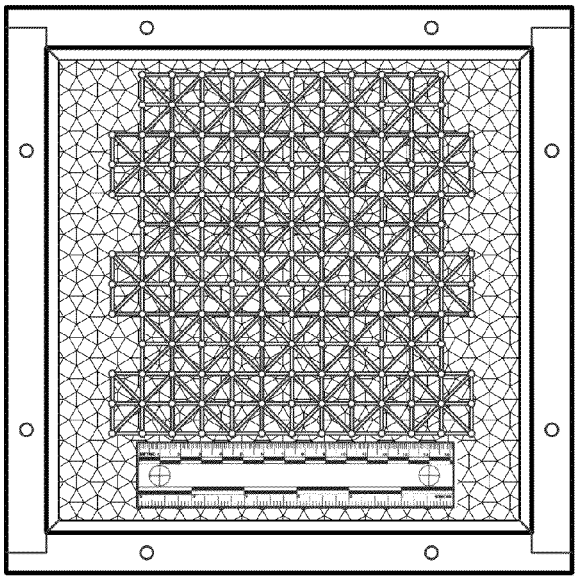
Figure 14B:
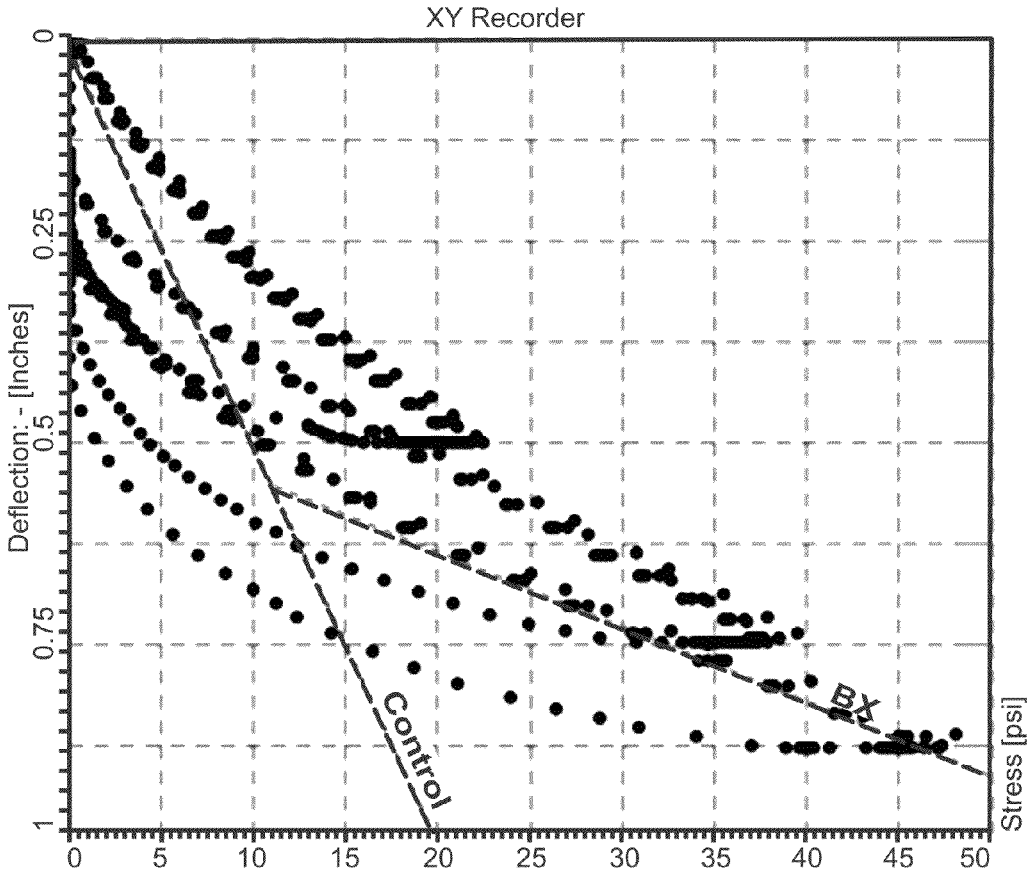
Figure 15A:
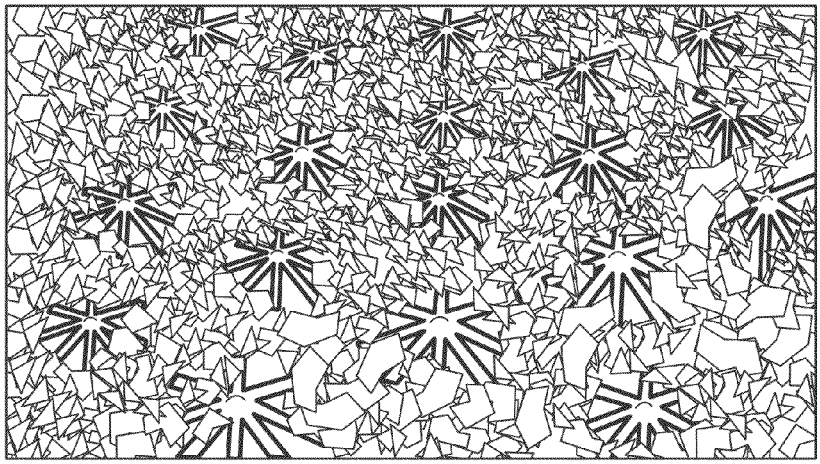
Figure 15B:
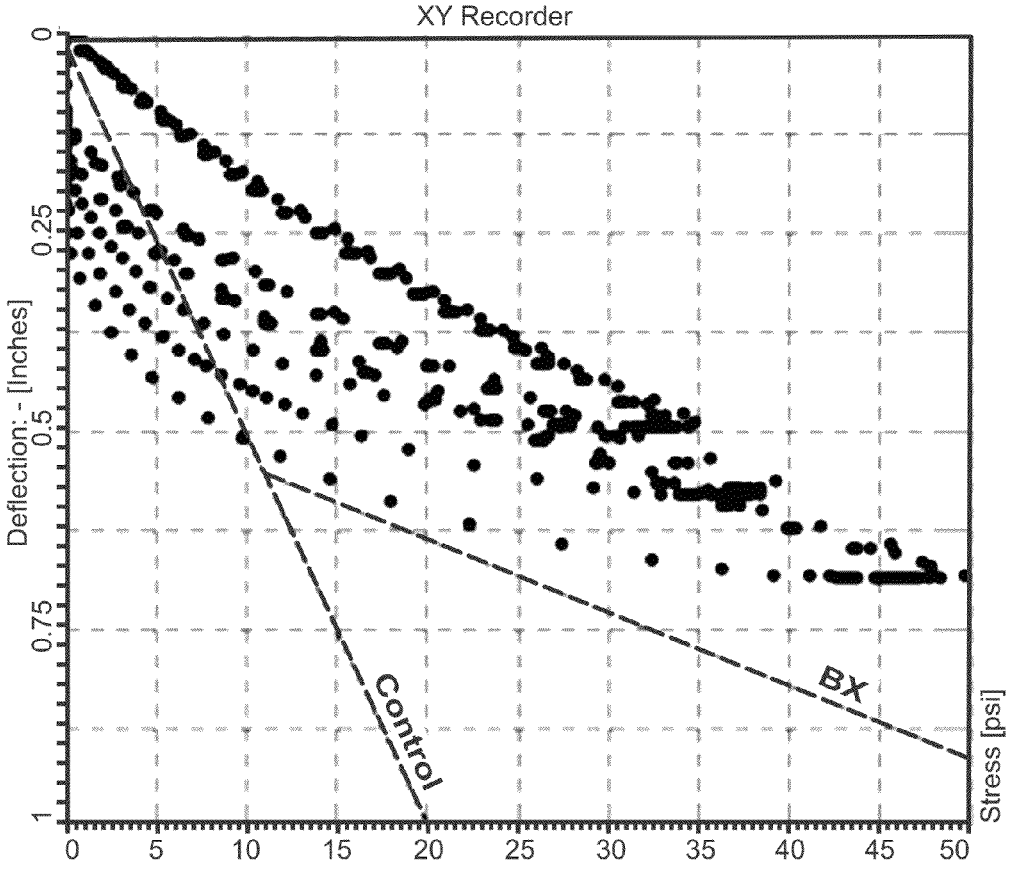
Figure 16A:
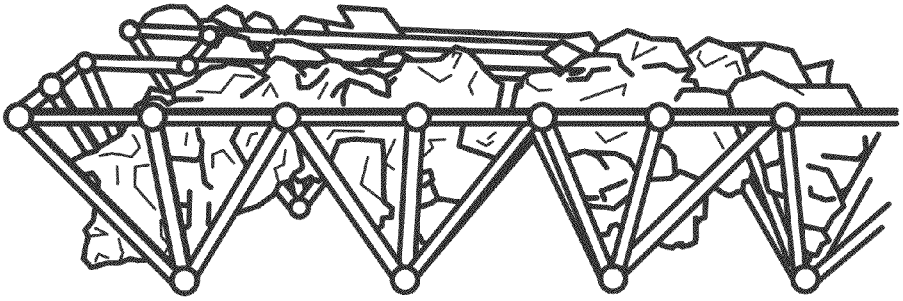
Figure 16B:
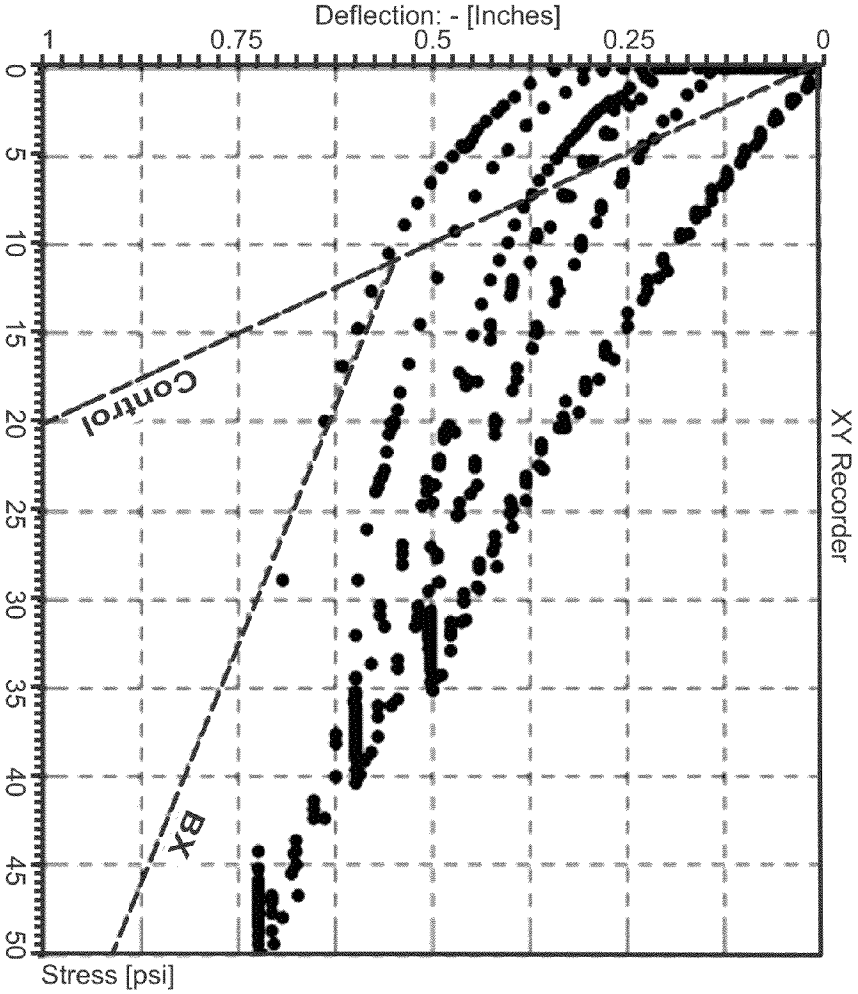
Figure 17A:
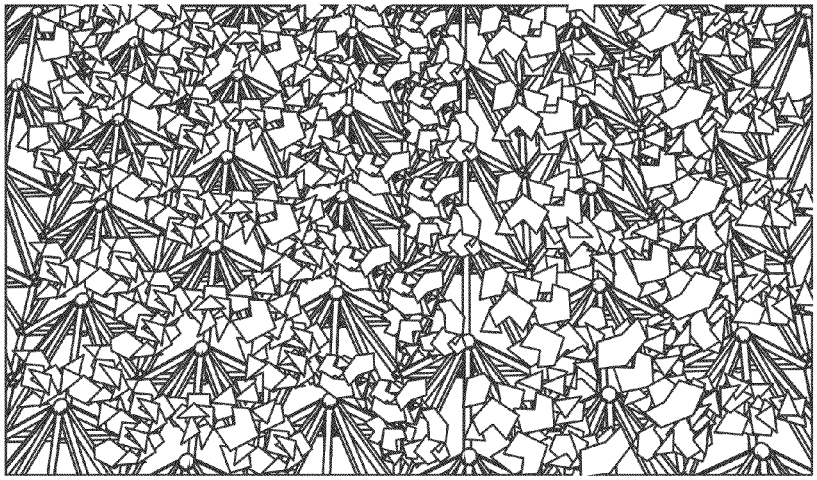
Figure 17B:
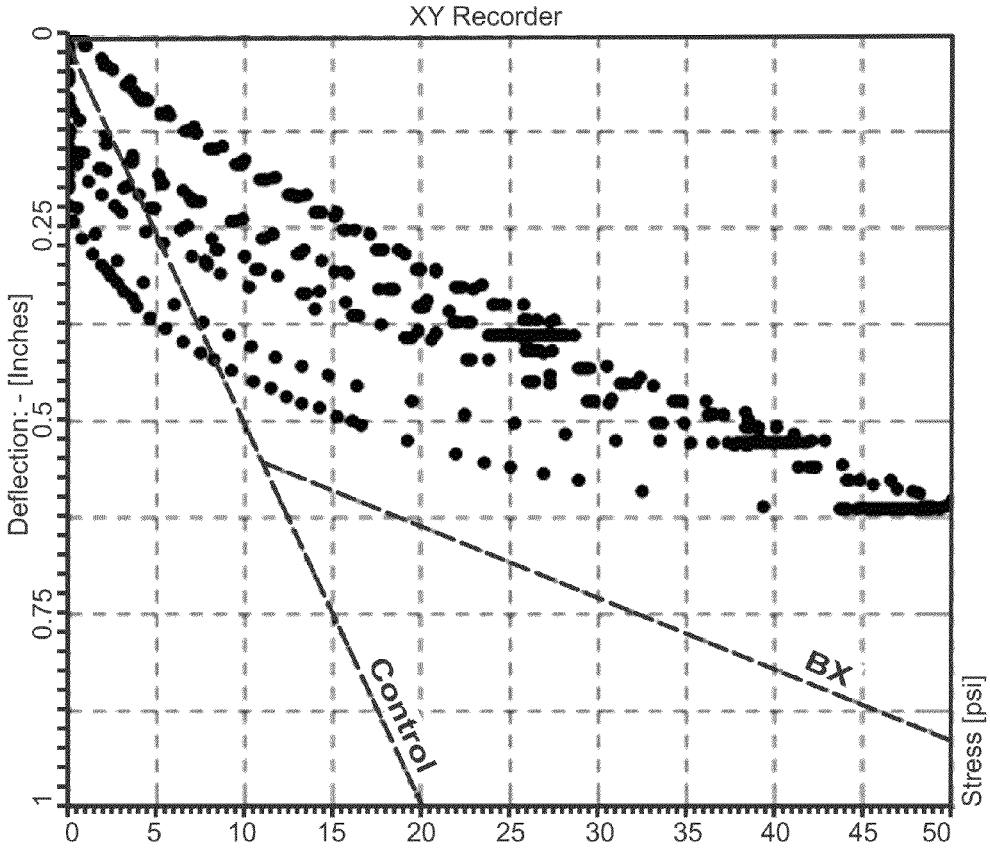
Figure 18A:
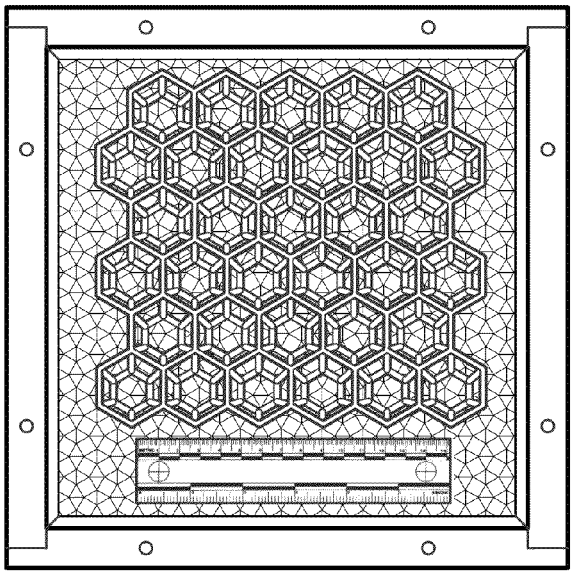
Figure 18B:
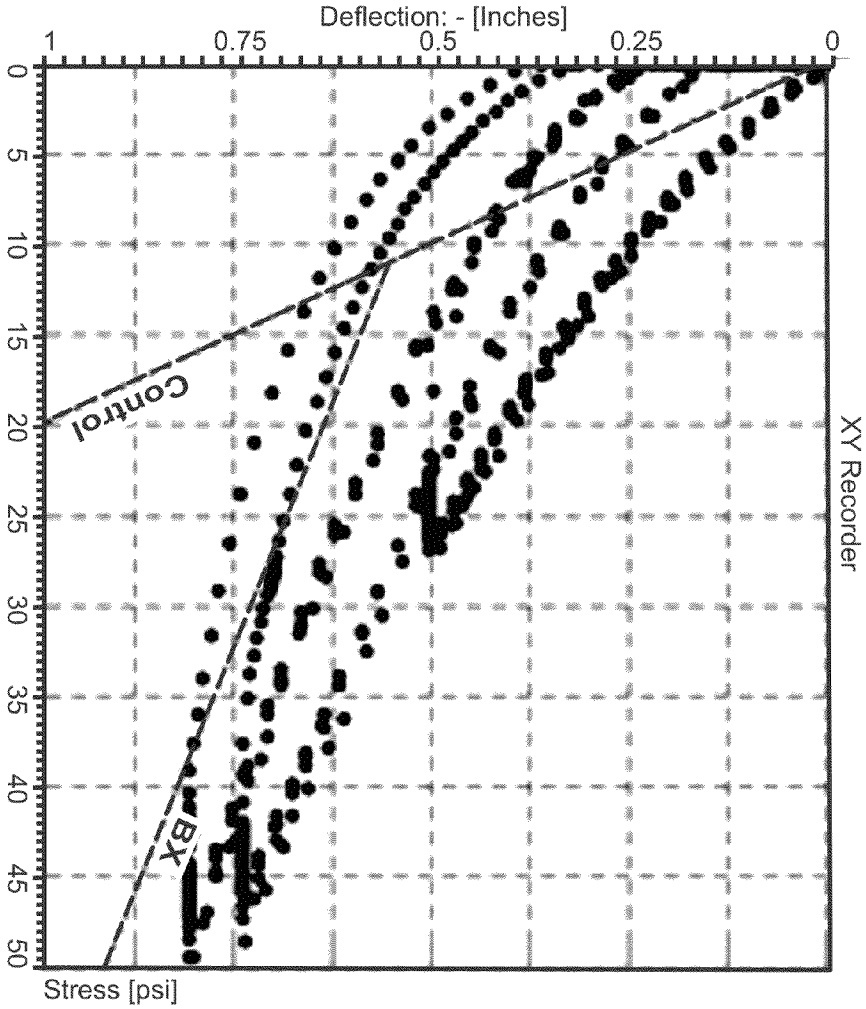
Figure 19A:
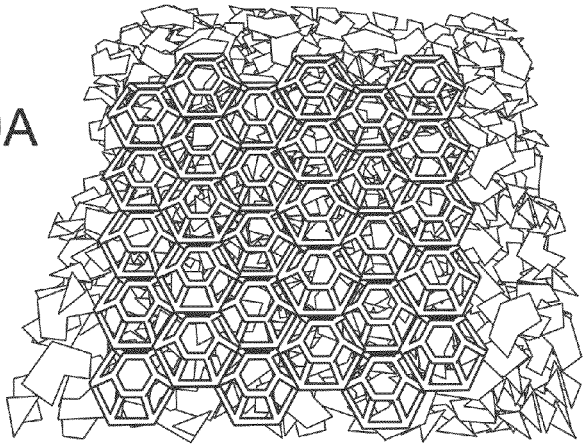
Figure 19B:
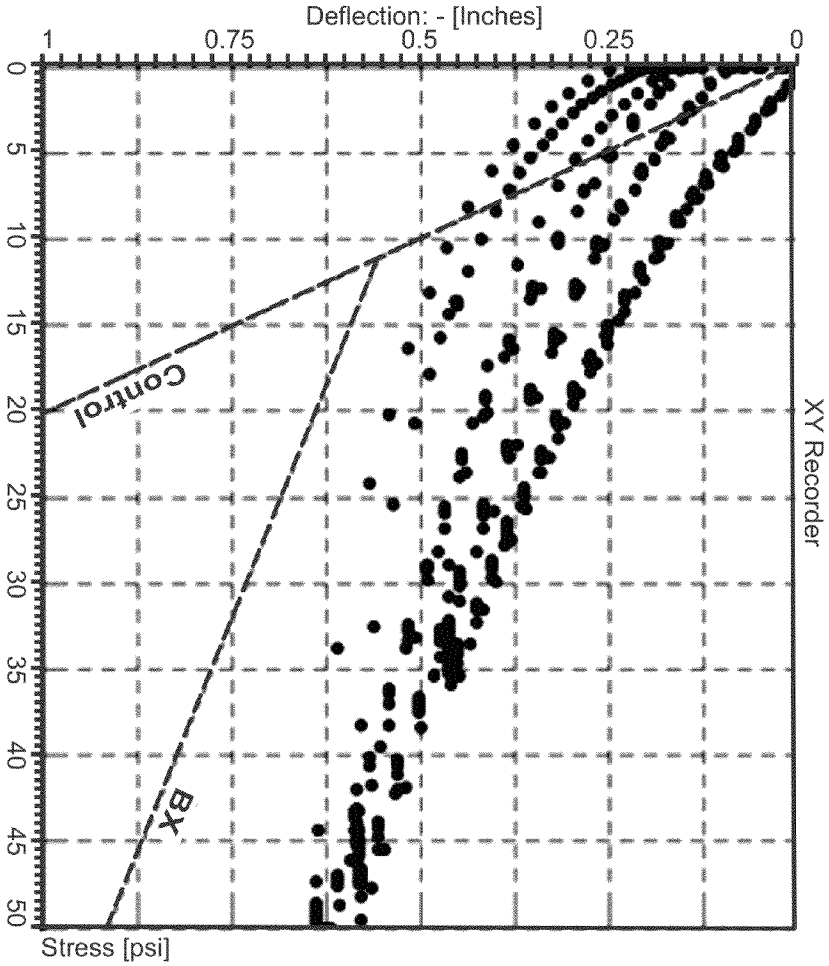
Figure 21A:
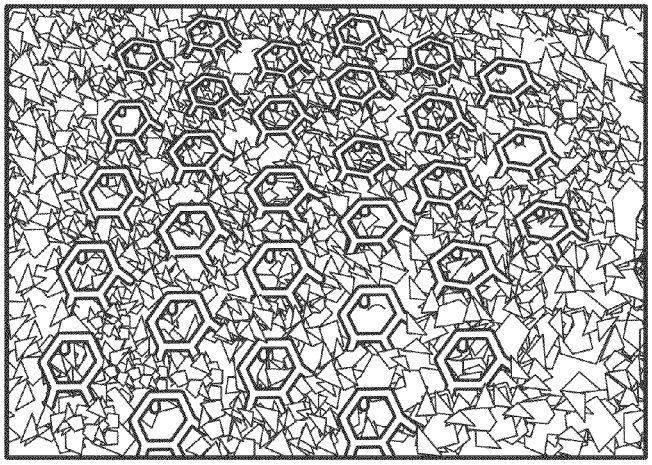
Figure 21B:
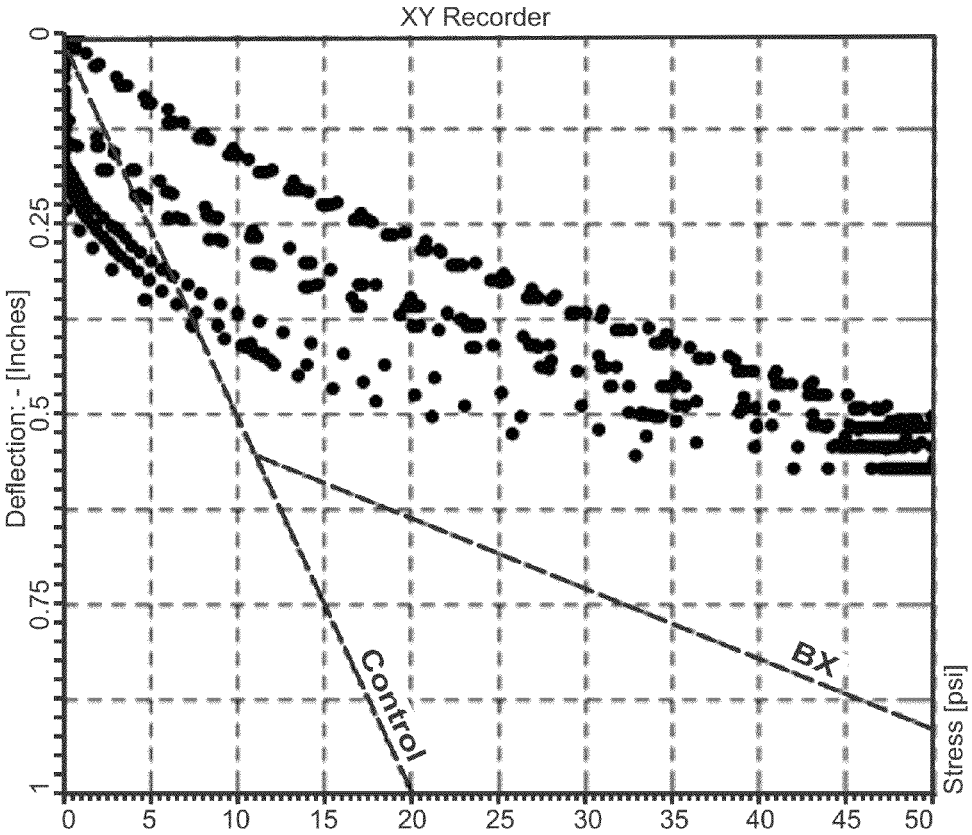
Figure 22A:
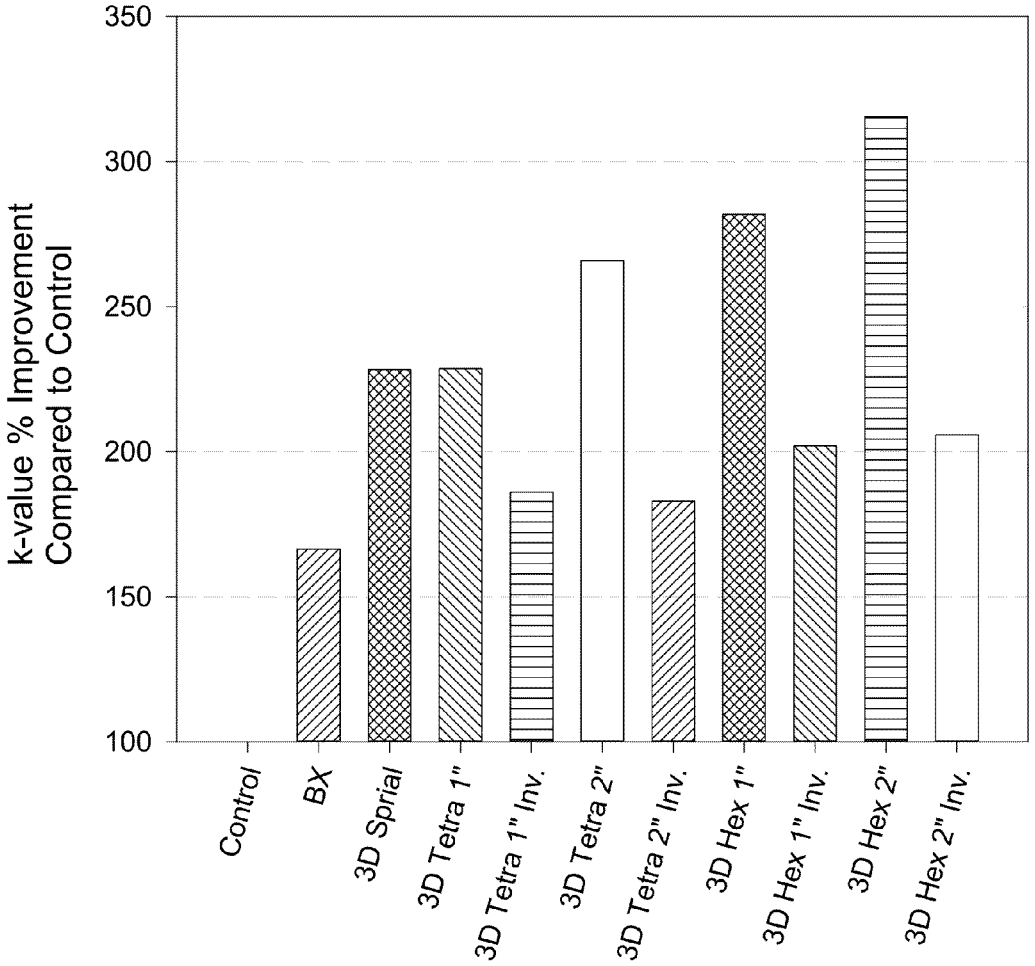
Figure 22B:
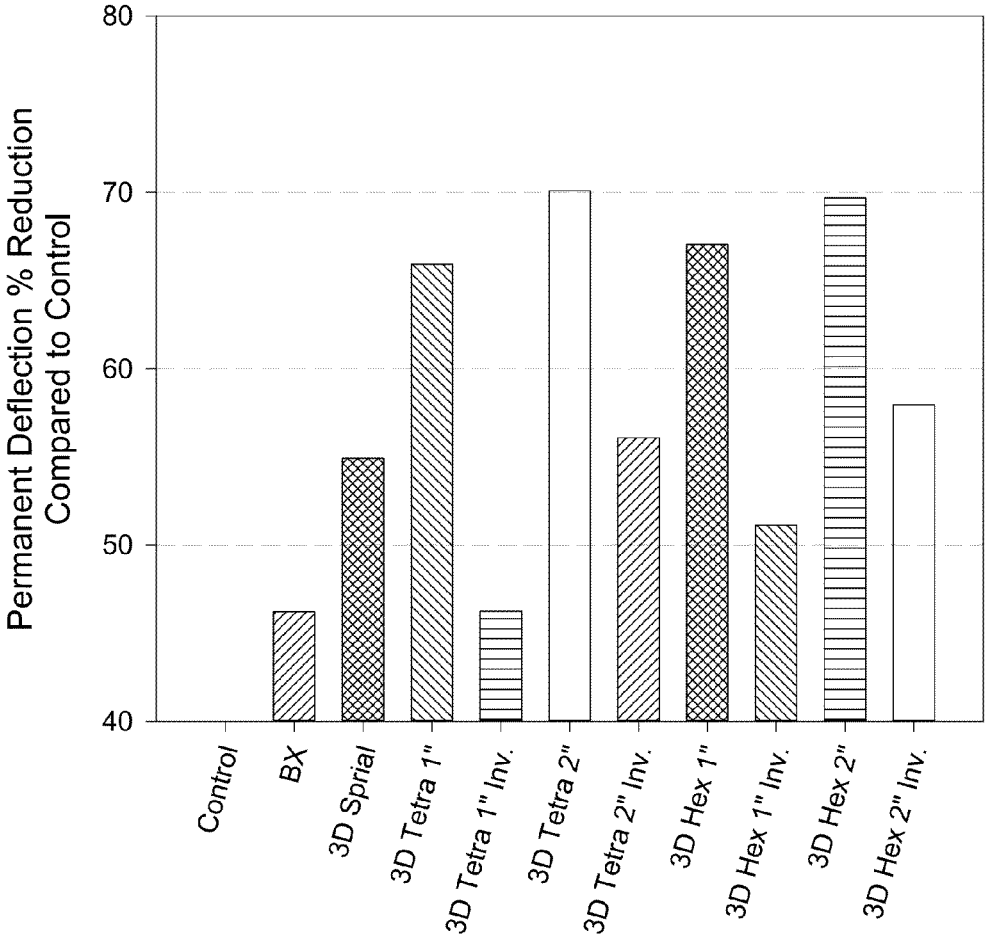
Figure 23A:
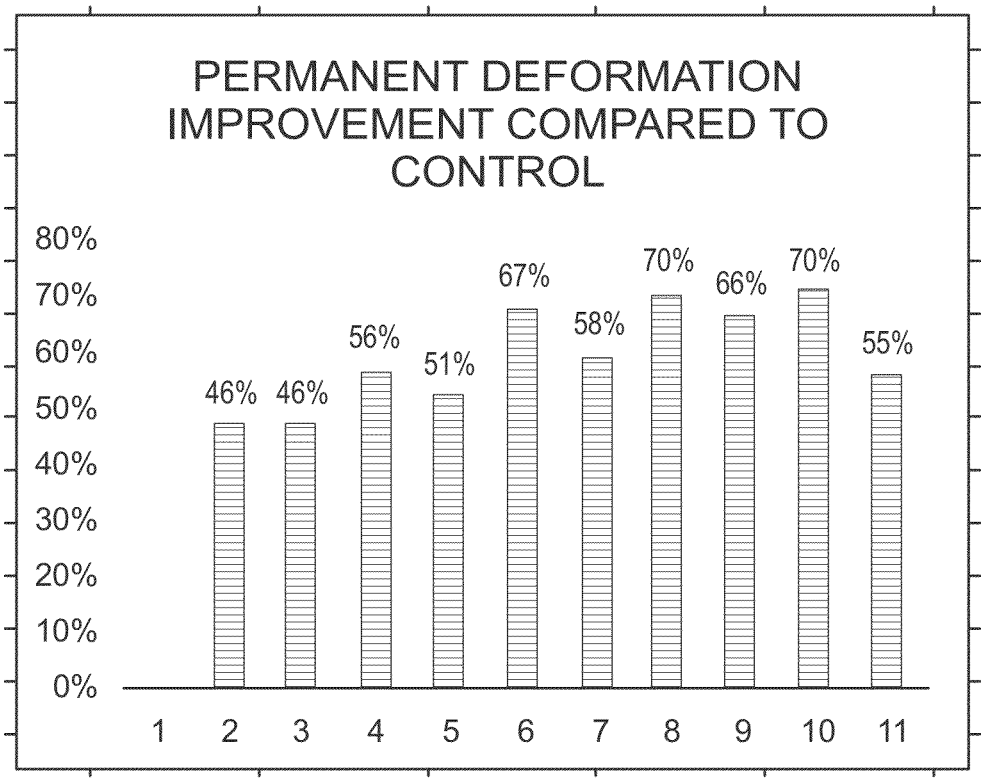
Figure 23B:
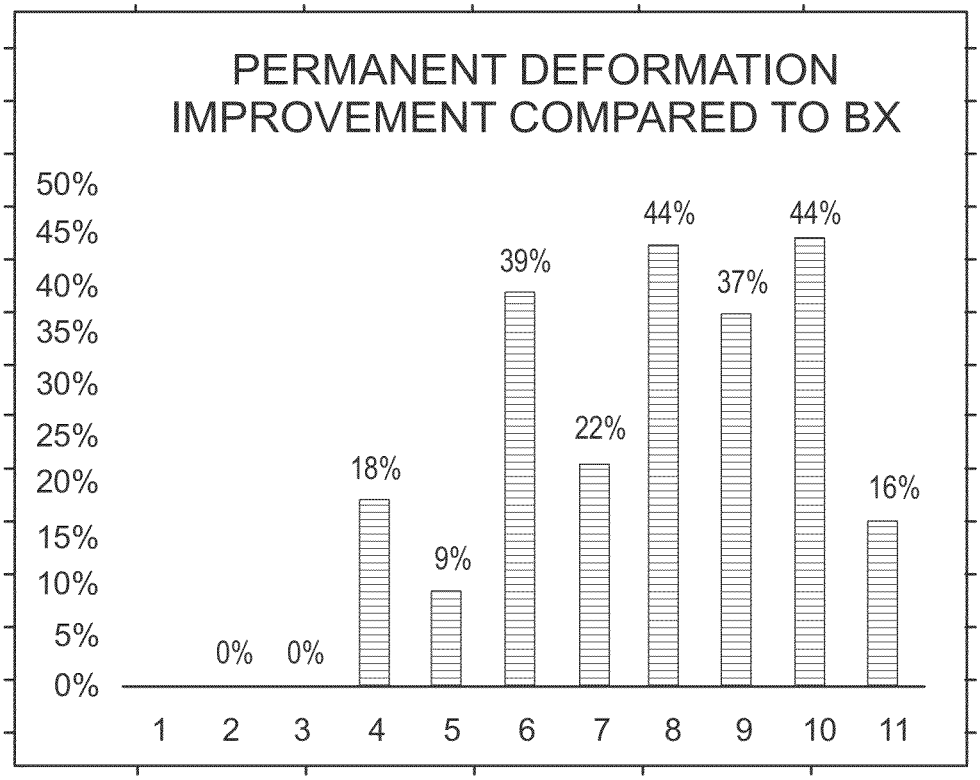
Figure 23C:
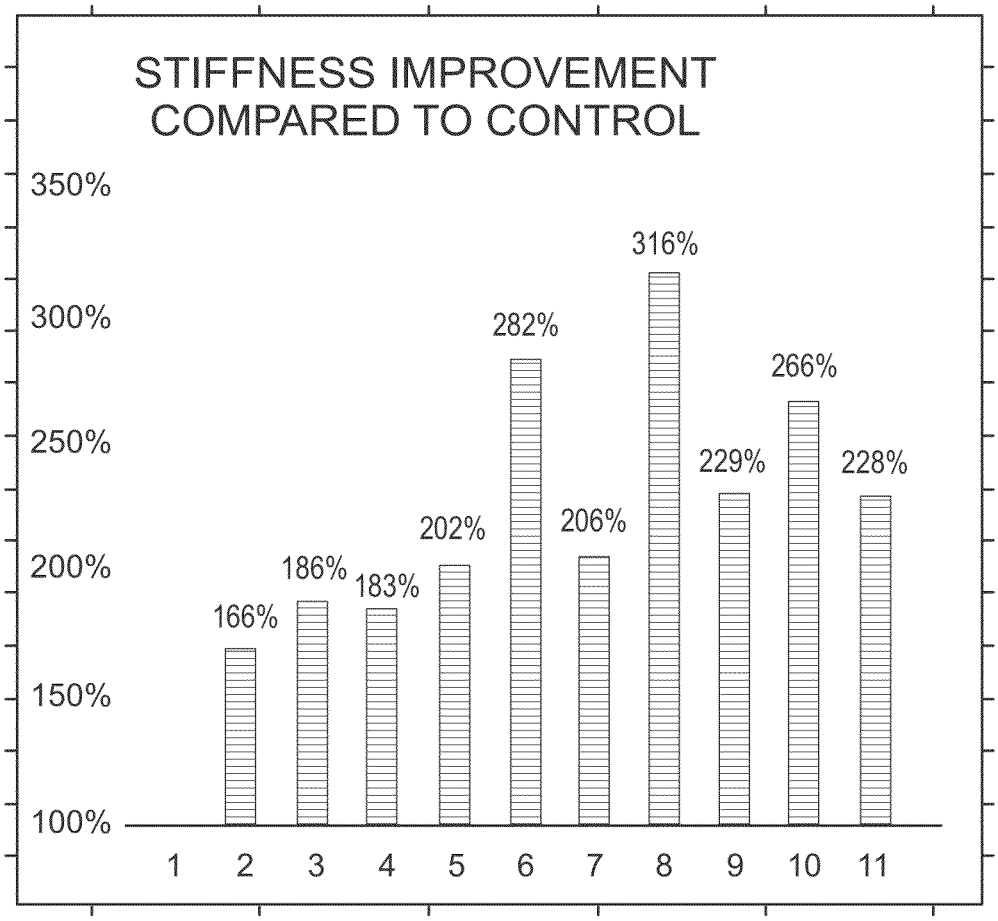
Figure 23D:
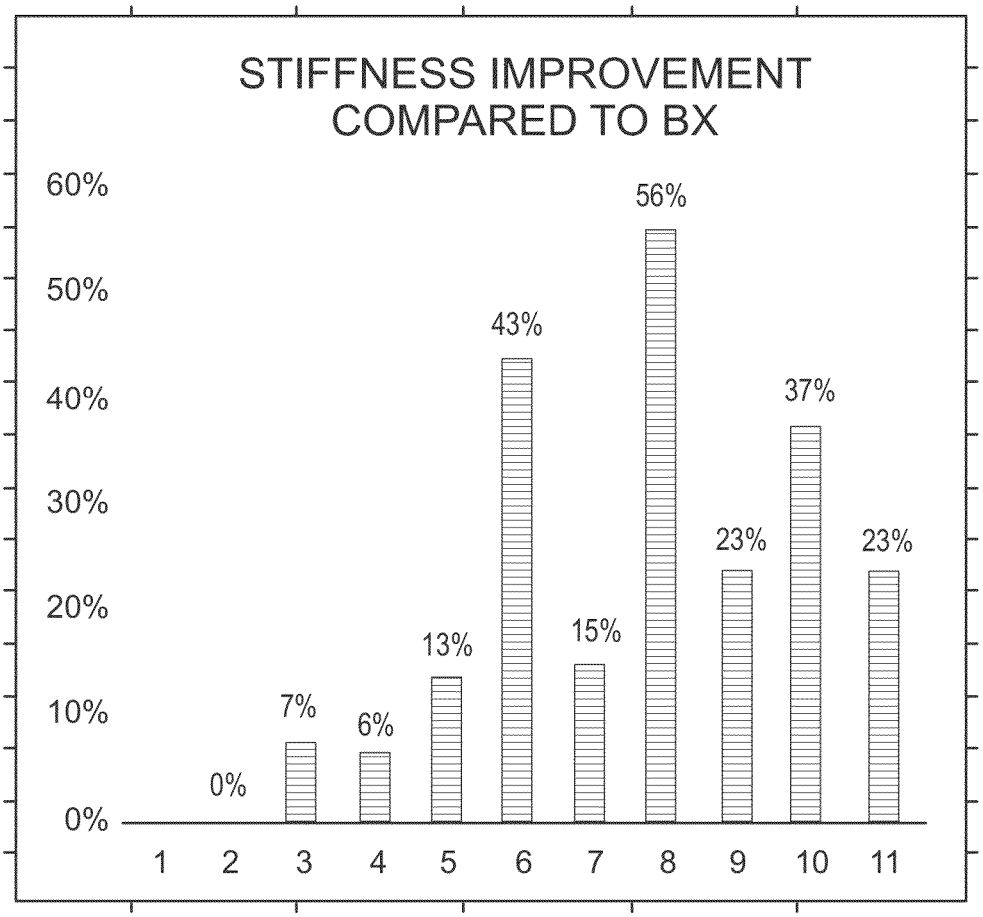

Having thus described the presently disclosed subject matter in general terms, reference will now be made to the accompanying Figures, which are not necessarily drawn to scale, and wherein:

FIG. 1 shows a cross-sectional view of a profile of an aggregate layer during compaction wherein the compaction is enhanced by three-dimensional (3D) protrusions in accordance with embodiments of the present disclosure;

FIGS. 2A and 2B, respectively, show perspective views of example 3D pyramidal and 3D inverted pyramidal grids with lower height projecting ribs in accordance with embodiments of the present disclosure;

FIGS. 3A and 3B, respectively, show perspective views of example 3D pyramidal and 3D inverted pyramidal grids with higher height projecting ribs in accordance with embodiments of the present disclosure;

FIGS. 4A and 4B, respectively, show perspective views of example 3D hexagonal and 3D inverted hexagonal grids with lower height projecting ribs in accordance with embodiments of the present disclosure;

FIGS. 5A and 5B, respectively, shows perspective views of example 3D hexagonal and 3D inverted hexagonal grids with higher height projecting ribs in accordance with embodiments of the present disclosure;

FIG. 6 shows a perspective view of an example self-projecting spiral grid which is generally two-dimensional (2D) before use and whereby the projections project into the aggregate during compaction to form a three-dimensional grid in accordance with embodiments of the present disclosure;

FIGS. 7A and 7B show perspective views of another example self-projecting spiral grid which is generally two-dimensional before use and whereby the projections project into the aggregate during compaction to form a three-dimensional grid in accordance with embodiments of the present disclosure;

FIGS. 8A and 8B shows diagrams of an example 2D grid that creates a three-dimensional projection of vertically and laterally constrained aggregate at locations in the third direction in accordance with embodiments of the present disclosure;

FIGS. 9A to 9C depict various diagrams and equations showing an increase in the bending moment of inertia that is created by 3D grids as compared to the conventional 2D grid in accordance with embodiments of the present disclosure;

FIGS. 10A-10G show testing procedures, which include images of a test box, aggregate added to the test box, compaction using a hand tamper, and an image of a testing apparatus in accordance with embodiments of the present disclosure;

FIGS. 11A and 11B, respectively, show an image of a test box with aggregate and no reinforcement (control), and a graph including stress-deflection data;

FIGS. 12A and 12B, respectively, show an image of a test box with aggregate and biaxial polymeric grid; and a graph including stress-deflection data;

FIGS. 13A and 13B, respectively, show an image of a test box with aggregate and an embodiment of a spiral self-projection grid; and a graph showing stress-deflection data;

FIGS. 14A and 14B, respectively, show an image of a test box with aggregate and an embodiment of an inverted pyramidal grid (1 inch), and a graph showing stress-deflection data;

FIGS. 15A and 15B, respectively, show an image of a pyramidal grid (1 inch) facing up with aggregate; and a graph showing stress-deflection data;

FIGS. 16A and 16B, respectively, show an image of an inverted pyramidal grid (2 inches) with aggregate; and a graph showing stress-deflection data;

FIGS. 17A and 17B, respectively, show an image of a pyramidal grid (2 inches) facing up with aggregate; and a graph showing stress-deflection data;

FIGS. 18A and 18B, respectively, show an image of an inverted hexagonal grid (1 inch) with aggregate; and a graph showing stress-deflection data;

FIGS. 19A and 19B, respectively, show an image of a hexagonal grid (1 inch) facing up with aggregate; and a graph showing stress-deflection data;

FIGS. 20A and 20B, respectively, show an image of an inverted hexagonal grid (2 inches) with aggregate; and a graph showing stress-deflection data;

FIGS. 21A and 21B, respectively, show an image of a hexagonal grid (2 inches) facing up with aggregate; and a graph showing stress-deflection data;

FIGS. 22A and 22B, respectively, show stiffness improvement graphs of test results using different aggregate reinforcements, and permanent deformation reduction graphs of test results using different aggregate reinforcements; and FIGS. 23A-23D show various graphs depicting stiffness improvement and permanent deformation reduction as compared to the control (no reinforcement) and biaxial polymeric grid.

DETAILED DESCRIPTION

The presently disclosed subject matter now will be described more fully hereinafter with reference to the accompanying Figures, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Figures. Therefore, it is to be understood that the presently disclosed subject matter is not to be limited to the specific embodiments disclosed and that modifications and other embodiments are intended to be included within the scope of the appended claims.

The presently disclosed subject matter provides three-dimensional (3D) aggregate reinforcement systems and two-dimensional (2D) aggregate reinforcement systems that create 3D projections and methods of use thereof. These aggregate reinforcement systems can increase the density, lateral confining stress, and/or composite grid-aggregate bending stiffness to reduce subgrade stress and accompanying deflection.

The terms "particulate" or "aggregate" can refer to rocks, stones, gravel, sand, earth, clay, aggregate, and the like, whether or not held by a binder such as, but not limited to, asphalt or cement, concrete, or any other suitable particulate or cohesive material used in geotechnical engineering or building.

The presently disclosed 3D aggregate reinforcement systems can aid in the compaction of aggregate layers by providing immobile or reduced mobility 3D projections that act as sidewalls during compaction. Aggregate that is compacted against immobile or nearly immobile projections can have increased density and can develop larger lateral stresses than aggregate that is compacted in the free field or aggregate that is confined along its base by conventional 2D geogrids. Increased density and lateral stress can result in increased stiffness that enhances the response of the pavement system. Further, the presently disclosed 3D aggregate reinforcement systems can increase stiffness through increased composite moment area compared to planar grids.

In accordance with embodiments, a reinforcement system may include a 3D fabricated framework. In other embodiments, the reinforcement system can include a 2D framework that projects into the aggregate layer during compaction. In other embodiments, the reinforcement system can include a 2D framework that results in the creation of ridges of aggregate with reduced lateral mobility that provide 3D projections of confinement within the aggregate layer. The presently disclosed subject matter may provide a 3D aggregate reinforcement system that allows the placed aggregate to be readily compacted into a dense state that is stiffer than aggregate compacted using suitable methods or aggregate placed and compacted using conventional geogrids as compaction aids.

In accordance with embodiments of the present disclosure, FIG. 1 illustrates a cross-sectional view of an example 3D aggregate reinforcement system 100 which may be placed within aggregate base course stone 1000 for improving the stiffness of aggregate and strengthening and stiffening a particulate material. Referring to FIG. 1, a roller compaction drum 150 is shown moving in a direction indicated by arrow 152. The drum 150 compacts uncompacted aggregate 154 to leave compacted aggregate 156 behind. Double-sided arrow 158 indicates the reduction in thickness of the aggregate after compaction. As will be understood, the spring stiffness of the reinforced, compacted aggregate 154 is higher than the spring stiffness of the uncompacted aggregate 156. The 3D aggregate reinforcement system 100 and other various embodiment of the 3D aggregate reinforcement system, such as 200, 300, 400, 500, which are capable of improving the stiffness of aggregate and strengthening and stiffening a particulate material will now be described herein with reference to the related figures.

Referring to FIG. 2A, the 3D aggregate reinforcement system 100 (hereinafter referred to as "reinforcement system 100") may include a grid structure 102 and multiple projections 104 configured to the grid structure 102. The grid structure 102 may substantially extend along a plane 102*a*. In an example embodiment, the grid structure 102 may be configured of a framework of spaced-apart bars 102*c* that are arranged in a relation to each other to form a series of off-set square patterns, such as 102*d*. Further, each of the plurality of projections 104 may include at least one end 104*a* attached to the grid structure 102 and another end 104*b* that may extend in a direction away from the plane 102*a*.

As shown in example FIG. 2A, the projections 104 extend in an upward direction away from the plane 102*a*, obtaining a structure of the reinforcement system 100 like a 3D pyramidal grid with upside projecting ribs. Example FIG. 2B is shown to include the projections 104 extending in a downward direction away from the plane 102*a*, obtaining a structure of the reinforcement system 100 like a 3D inverted pyramidal grid with downside projecting ribs. In the examples FIGS. 2A and 2B, the 3D pyramidal grid and the 3D inverted pyramidal grid, are, respectively, shown to include the plurality of projections 104 of lower heights. Such projections 104 may extend with the offset square pattern 102*d* for the lower horizontal ribs and pyramid vertical projects with a center node 104*c* at the peak of the pyramid. The embodiment as shown in example FIGS. 2A and 2B may include range dimensions of about 1 inch to 3 inches nominal square pattern, about 0.05 inches to about 0.2 inches thick square ribs, about 0.1 inches to 0.3 inches diameter nodes, and about 0.50 inches to 1.75 inched height at the top of the pyramid. In an embodiment of example FIGS. 2A and 2B the specific dimensions may be of about 2 inch nominal square pattern, about 0.1 inch thick square ribs, about 0.2 inch diameter nodes, and about 1 inch height at top of pyramid.

Without departing from the scope of the present disclosure, the plurality of projections 104 may include higher heights as shown in example FIGS. 3A and 3B. FIGS. 3A and 3B respectively show embodiments of 3D pyramidal and inverted pyramidal grids with higher horizontal ribs with the offset square pattern 102*d* for the higher horizontal ribs and pyramid vertical projects with a center node 104*c* at the peak of the pyramid. The embodiment as shown in example FIGS. 3A and 3B may include range dimensions of about 1 inch to 3 inches nominal square pattern, about 0.05 inches to about 0.2 inches thick square ribs, about 0.1 inches to 0.3 inches diameter nodes, and about 1.75 inches to 2.75 inches height at top of pyramid. The embodiment of FIGS. 3A and 3B specific dimensions may be of 2 inch nominal square pattern, 0.1 inch thick square ribs, 0.2 inch diameter nodes, and 2 inch height at top of pyramid.

The projections 104, as shown in example FIGS. 2A to 3B, are substantially pyramidal shaped. However, without departing from the scope of the present disclosure, the projections 104 may be substantially hexagonal or spiral shaped.

In example FIGS. 4A to 5B an embodiment of a 3D aggregate reinforcement system 200 (hereinafter "reinforcement system 200") of varying heights and projections are shown. In example FIG. 4A, the reinforcement system 200 may include a grid structure 202 that may substantially extend along a plane 202*a*. In an example embodiment, the grid structure 202 may be configured of a framework of spaced-apart bars 202*c* that are arranged in relation to each other to form a series of hexagonal patterns, such as 202*d*. Further, each projection 204 may include at least one end 204*a* attached to the grid structure 202 and another end 204*b* that may extend in a direction away from the plane 202*a*. As shown in example FIG. 4A, the other end 204*b* of projections 204 may configure, similar to the grid structure 202, a framework of a series of hexagonal patterns. In such embodiment, the reinforcement system 200 may include the grid structure 202 with the bigger hexagonal pattern 202*d*, and the projections 204 of smaller hexagonal patterns 204*c* positioned above obtaining upwardly oriented 3D hexagonal reinforcement system 200. Similarly, example FIG. 4B, shows downwardly oriented 3D hexagonal reinforcement system 200.

In both the examples FIGS. 4A and 4B, the nodes of bigger hexagonal pattern 202*c* of the grid structure 202 connect the corresponding nodes of smaller hexagonal pattern 204*c* of the grid structure 202. In the embodiment shown in FIGS. 4A and 4B, the connection between the nodes of bigger hexagonal pattern 202*c* of the grid structure 202 and the corresponding nodes of smaller hexagonal pattern 204*c* of the grid structure 202 may be of lower heights, which may be obtained by the dimensions, such as, of the hexagonal patterns of the bigger and upper ones of about 1 inch to about 3 inches between parallel ribs, and about 0.5 inches to about 1.5 inches of hexagonal pattern between parallel ribs of the smaller and top ones, and about 0.05 inches to about 0.2 inches square ribs, and about 0.1 inches to about 0.2 to about 0.3 inches diameter nodes. In an embodiment, the specific dimensions may be of about 2 inch between parallel ribs, and about 1 inch hexagonal pattern between parallel ribs of the smaller and top ones, and about 0.1 inch square ribs, and about 0.2 inch diameter nodes Further, without departing from the scope of the present disclosure, the plurality of projections 204 may include higher heights as shown in example FIGS. 5A and 5B. Example FIGS. 5A and 5B, respectively, show embodiments of a hexagonal reinforcement system and a 3D inverted hexagonal reinforcement system 200 with the projections 204 of higher heights. Higher height hexagonal reinforcement system 200 may be obtained by having dimensions of about 1 inch to about 3 inches hexagonal pattern between parallel ribs of the bigger ones, 0.5 inches to 1.5 inches hexagonal pattern between parallel ribs of the smaller ones, about 0.05 inches to about 0.2 inches square ribs, and about 0.1 inches to about 0.3 inches diameter nodes. In some embodiments, specific dimensions may be of about 2 inch hexagonal pattern between parallel ribs of the bigger ones, about 1 inch hexagonal pattern between parallel ribs of the smaller ones, about 0.1 inch square ribs, and about 0.2 inch diameter nodes. In any of the above example embodiments, the projections 104, 204, higher or lower, may extend at least about 0.5 inches from the plane 102*a* or 204*a*.

Referring now to FIG. 6, a 3D self-projecting aggregate reinforcement system 300 (hereinafter referred to as "self-projecting system 300") is shown in accordance with an exemplary embodiment of the present disclosure. The self-projecting system 300 may include a grid structure 302 and a plurality of projections 304. The grid structure 302 may substantially extend along a plane 302*a*. Further the plurality of projections 304 may extend in a direction away from the plane in response to compaction with aggregate. The grid structure 302 may include a series of hexagonal patterns 302*a* with center node 302*b* connecting spiral ribs 302*c* (also termed "3D Spiral" herein). The center nodes 302*b* at the center of the spiral ribs 302*c* may include lower spring stiffness initially compared to the nodes 302*d* of the hexagonal patterns 302*a*. During aggregate placement, the spiral center nodes 302*b* deform or project downward below the hexagonal nodes 302*d* to increased aggregate compactability and generate increased area moment of inertia. Upon the placement of aggregate on the spiral center nodes 302*d*, the projections 304 are configured due to center nodes 302*b* projecting downward below the hexagonal nodes 302*d*. At least one of the advantages of this self-projecting grid is its ability to be manufactured as a 2D planar element and shipped in rolls. When the self-projecting grid is compacted with aggregate, it projects into a three-dimensional configuration. The embodiment shown in FIG. 6 may include dimensions of about 1 inch to about 3 inches hexagonal pattern (between parallel ribs), about 0.05 to about 0.2 inches square ribs, about 0.1 inches to about 0.3 inches diameter nodes, and six spiral ribs with lengths of about 1.5 inches to about 1.6 inches over distance of about 0.945 to about 0.965 inches. In an embodiment of FIG. 6 specific dimensions may be of about 2 inch hexagonal pattern (between parallel ribs), about 0.1 inch square ribs, about 0.2 inch diameter nodes, and six spiral ribs with lengths of about 1.474 inches over distance of about 0.955 inches.

Another embodiment of the present subject matter is shown in FIGS. 7A and 7B for aggregate reinforcement system that may be a 2D grid and capable of creating a projection upon the placement of the aggregate thereon to obtain a 3D aggregate reinforcement system. The aggregate reinforcement system 400 may include a grid structure 402 that substantially extends along a plane, as described above with reference to other figures. The grid structure 402 may be formed of a series of hexagonal patterns. Further, the aggregate reinforcement system 400 may include a plurality of first moveable portions 404 and a plurality of second moveable portions 406. As shown in the encircled portion of example FIG. 7A that illustrates one hexagonal pattern of the grid structure 402, which configures the first movable member 404 having nodes 404*a*; and the second movable member 406 that may be spiral ribs 406*a* extending from each node 404*a* of the first movable member 404 and connected at a center of the first movable member 404 configuring a center node 406*b*. Such structure of the second movable portion 406 may enable more flexibility therein as compared to the first movable portion 404. The center node 406*b* of the spiral ribs 406*a* of the second movable portion 406 provides lower spring stiffness compared to the nodes 404*a* of the first movable member 404. As shown in FIG. 7B, when aggregate is added to the grid structure 402, the second movable member 406 results in the projection of vertically and laterally constrained aggregate at the second moveable portions in a direction away from the plane.

Another embodiment of the present subject matter is shown in example FIGS. 8A and 8B for aggregate reinforcement system 500 that may be a 2D grid and capable of creating a projection of relatively immobile aggregate in the out-of-plane direction. The 3D aggregate reinforcement system 500 shown in FIG. 8A includes a grid structure 502 having horizontal tension elements 504 that may be connected to in-plane 2D projection elements 506. As shown in FIG. 8B, the in-plane 2D projection elements 506 may be positioned in groups together to create lateral, relatively immobile walls of aggregate 508. When the lifts of aggregate are placed over the aggregate reinforcement system 500, the portion of the aggregate that is captured by the 2D projection elements 508 is hindered from lateral movement. The aggregate reinforcement system 500 may be biaxial or triaxial in configuration, or may have other configurations provided it renders the captured aggregate vertically and laterally immobile. As the aggregate is compacted, the ridges of laterally relatively immobile aggregate form lateral barriers against which the aggregate that is placed in between the ridges 510 is compacted. In this way the 2D configuration of the aggregate reinforcement system 500 forms vertical projections 512 of laterally relatively immobile ridges of aggregate.

In some embodiments, the presently disclosed 3D aggregate reinforcement systems also function by increasing the bending moment of resistance of the aggregate layer. Example FIGS. 9A to 9C illustrate comparison of increasing bending movement on 2D and 3D structure. FIGS. 9A and 9B shows the behavior of a simply-supported beam 600 that is subject to uniform vertical loading 610. The center-of-beam deformation that occurs from loading is shown in FIG. 9B, whereby a larger bending moment of inertia (I) provided by the beam section results in a smaller deformation (δ). Further, FIG. 9C shows how the formation of a three-dimensional configuration results in a significantly larger bending moment of inertia (referred as $I_{composite}$) that resists deformations. Here $I_{composite}$ is variable of $I_{g+a}$ and $I_{rib}$, where $I_{g+a}$ is movement of inertia of portion 'a' of 3D structure, $I_{rib}$ is movement of inertia of portion 'b' (rib).

The presently disclosed subject matter also provides methods for using the presently disclosed aggregate reinforcement systems, such as system 100, 200, 300 and 400. In some embodiments, the method improves the stiffness of aggregate. The method may include positioning a three-dimensional aggregate reinforcement system on the ground. Further, adding aggregate to the aggregate reinforcement system. The aggregate reinforcement systems that include the plurality of projections which forms grids, as described above, may be configured such that the aggregate becomes locked in place. In an embodiment, the system may be positioned such that the plurality of projections of the aggregate reinforcement system are projected towards the ground. In further embodiments, the plurality of projections comprising the aggregate reinforcement system is projected away from the ground. Furthermore, the locked aggregate may be compacted.

In some embodiments, a method of strengthening a particulate material is provided. The method may include positioning a three-dimensional aggregate reinforcement system on the ground and adding aggregate to the aggregate reinforcement system as described above. The method may further include compacting the aggregate.

In an embodiment, the methods as described above may be used during earthwork or pavement construction, apart from road construction.

The systems of the present disclosure are advantageous in various scopes. The presently disclosed aggregate reinforcement systems comprise a grid whose primary purpose is to strengthen or reinforce soil and has open meshes into which soil particles can lock. In general, the grid is made up of strands (also called ribs) which are interconnected at bars running across the grid in the transverse direction or are interconnected at junctions (also called nodes or intersections). The strands may or may not be continuous throughout the grid. The presently disclosed reinforcement systems may be made of plastic, such as nylon (polyamide), polycarbonate, polypropylene, polyethylene and polyester. However without departing from the scope of the present disclosure, the reinforcement systems may be made of any other materials, for example, wood, rubber, steel, or any other material that allows the aggregate to be substantially immobile. Further, the presently disclosed reinforcement systems may be manufactured in many different ways, for instance, by stitch bonding fabrics, by weaving or by knitting, by extrusion, by 3D printing, or by spot-welding oriented plastic strands together. In some embodiments, the presently disclosed grids are formed by uniaxially or biaxially orienting a plastics sheet starting material which has been provided with holes. The holes form meshes in the product. In a uniaxially oriented grid of this type, transverse bars are interconnected by strands. Biaxially oriented grids of this type comprise oriented strands and junctions at which the strands meet, substantially each strand having each end connected to such a junction, whereby sets of parallel tensile members run through the grid, each tensile member being formed of a succession of substantially aligned strands and respective said junctions interconnecting the strands. Some embodiments of different types of 3D grids are presented herein although the presently disclosed subject matter is not limited to the shapes shown herein. The shapes can be any suitable shape, such as circular, square, pyramidal, spirals, or hexagonal, for example. In addition, the structures need not be uniform throughout and may encompass more than one type of shape in one aggregate reinforcement system.

EXAMPLE

Testing of 3D Reinforcement Systems

In this study, small sections of 3D reinforcement systems or 3D grids, such as systems 100, 200, 300, 400, 500, were manufactured using stereolithography (SLA) (i.e., 3D printing) and tested to evaluate and compare performance properties. ACCURA® XTREME™ White 200 plastic was used to replicate common plastic geogrid properties and produce specimens with sufficient durability for testing.

Different types of reinforcement systems as per the present invention were tested along with conventional 2D or biaxial grids. The biaxial grids used for the testing were manufactured using the SLA process with the same polymer as the other grids and served as a control for comparison to the 3D reinforcement systems. In an example, biaxial grids that were used for testing include the dimensions: 1 inch nominal square pattern, 0.1 inch square ribs, and 0.2 inch diameter nodes.

Figure 10C:
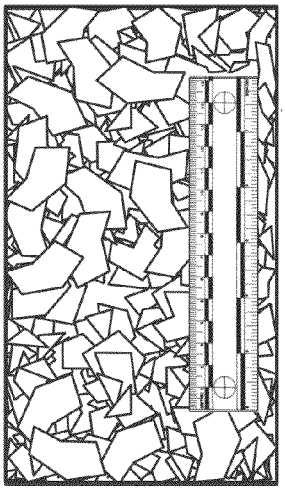
Figure 10B:
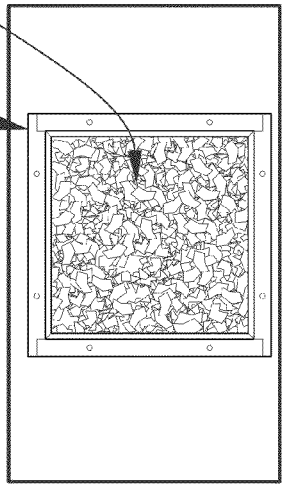
Figure 10A:
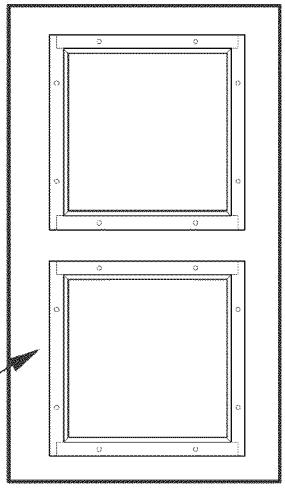
Figure 10F:
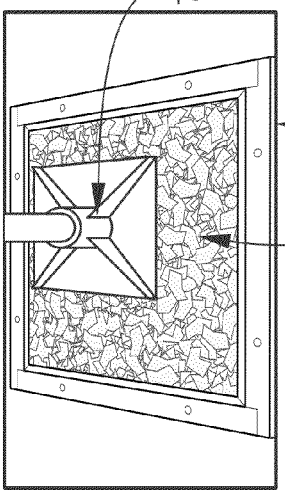
Figure 10E:
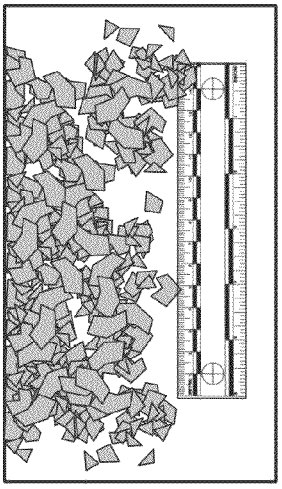
Figure 10D:
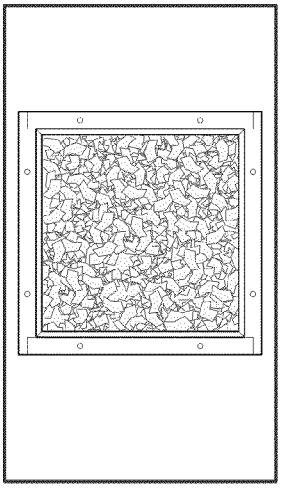

Testing of some embodiments of the presently disclosed structures was accomplished using a test box setup 700 including aggregate base course stone layer or aggregate 1000 with rather severe (conservative) test conditioning, as shown in FIGS. 10A to 10G. FIG. 10A illustrates a test box 700; FIGS. 10B-10E illustrate steps of adding aggregate 1000 to the test box 700; FIG. 10F illustrate compaction using a hand tamper 710. Severe conditions included soft, yet elastic subgrade (vastly reduced development of strain hardening compared to soil with a California Bearing Ratio value of approximately 0.5), unrestrained edges of the grids (no tension or bending stiffness at the perimeter), and shallow aggregate surface layer (limiting the full development of composite bending moment and stress distribution). The test box 700 as shown in FIG. 10A that was taken for conducting this test was a 16 inch square-shaped box, which was constructed to contain 4 inches of crumbed rubber (subgrade) and 3 inches of crushed limestone (sub base) (combindely 'aggregate 1000'). Depending upon the size of the box 700, a preferred size of the 3D reinforcement systems was selected, which was 12 inch square sections of grid placed at the rubber-aggregate interface. Further, as shown in FIG. 10F, the hand temper 710 was utilized to make 100 impacts on uniformly distributed aggregate 1000 for compaction by a single operator.

Figure 10G:
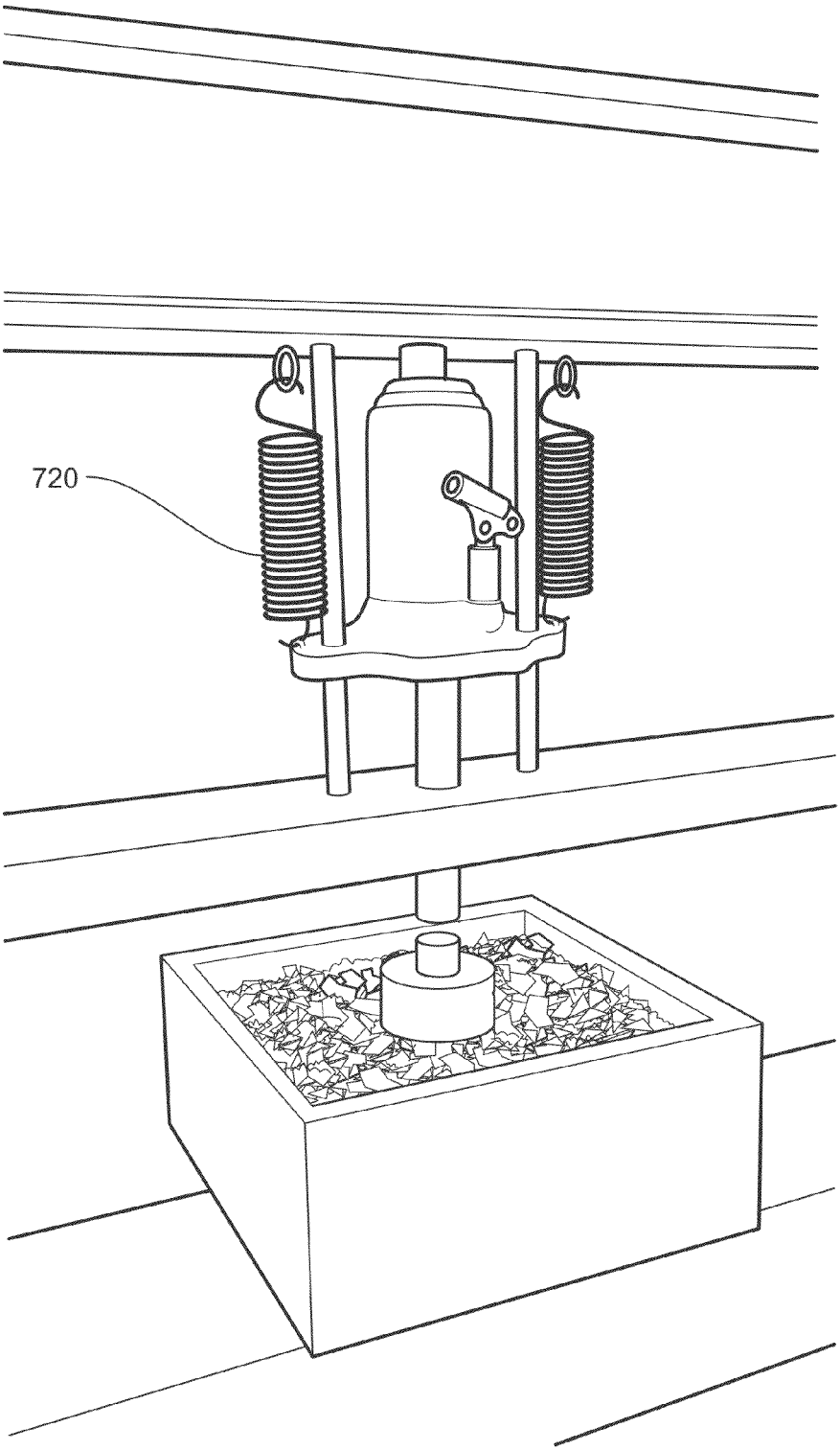

After the box 700 with the aggregate 1000 was ready, it was transferred for the testing that involved three load-unload cycles using a 4.5 inch diameter rigid plate, as shown in FIG. 10G. Load was measured using a calibrated load cell and deflection was measured using a wireline displacement device. Load was applied using a hand operated hydraulic jack 720. Modulus of subgrade reaction was calculated as the slope of the stress-deflection line between 30 psi and 50 psi during the final loading cycle. The sampling rate was 5 Hz. The control test was only loaded to 22 psi due to high deflection.

FIGS. 11A-21B show pictures of the testing process for each embodiment of 3D projection grid as well as deflection data of respective tests. A summary of the test results show that most of the 3D grids both increase the stiffness and reduce permanent deflection as compared to the control (no reinforcement) or BX (two-dimensional grid), as shown in graphs of FIGS. 22A and 22B. Test results presented as percentage improvement over the control or BX are also shown in FIGS. 23A-23D. Accordingly, the results show that the presently disclosed three-dimensional aggregate reinforcement systems stabilize aggregate material.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A three-dimensional aggregate reinforcement system comprising:

a grid structure that substantially extends along a plane; and a plurality of projections that each comprise at least one end extending upward from the grid structure, wherein the projections consist of a plurality of ribs that are spaced apart from each other, whereby the spacing of the ribs is such that aggregate is at least partially positioned between the ribs and the aggregate is constrained during use of the system.

2. The reinforcement system of claim 1, wherein the grid structure comprises plastic.

3. The reinforcement system of claim 1, wherein the other end of each of the plurality of projections extends at least about 0.5 inches from the plane.

4. The reinforcement system of claim 1, wherein the projections are shaped as one of a substantially pyramidal shape, a substantially hexagonal shape, and a substantially spiral shape.

5. A self-projecting three-dimensional aggregate reinforcement system comprising:

a grid structure that substantially extends along a plane; and a plurality of projections that extend upward in a direction away from the plane upon compaction with aggregate, wherein the projections consist of a plurality of ribs that are spaced apart from each other, whereby the spacing of the ribs is such that the aggregate is at least partially positioned between the ribs and the aggregate is constrained during use of the system.

6. The reinforcement system of claim 5, wherein the projections comprise plastic.

7. The reinforcement system of claim 5, wherein the projections each extend at least about 0.5 inches from the plane.

8. The reinforcement system of claim 1, wherein the projections are shaped as substantially spiral shapes.

9. The reinforcement system of claim 2, wherein the plastic comprises one of nylon (polyamide), polycarbonate, polypropylene, polyethylene, and polyester.

10. An aggregate reinforcement system comprising:

a grid structure that substantially extends along a plane;

a plurality of first moveable portions; and a plurality of second moveable portions, wherein the second moveable portions are more flexible then the first moveable portions such that addition of aggregate to the grid structure results in the projection of constrained aggregate at the second moveable portions in a direction away from the plane, wherein the plurality of second moveable portions consist of a plurality of ribs that are spaced apart from each other, whereby the spacing of the ribs is such that the aggregate is at least partially positioned between the ribs and the aggregate is constrained during use of the system.

11. The reinforcement system of claim 10, wherein the grid structure comprises plastic.

12. The reinforcement system of claim 10, wherein the constrained aggregate projects at least about 0.5 inches from the plane.

13. A method of improving the stiffness of aggregate, the method comprising:

positioning the reinforcement system of claim 1, 5, or 10 on the ground;

adding the aggregate to the reinforcement system; and compacting the aggregate.

14. The method of claim 13, wherein the projections extend towards the ground.

15. The method of claim 13, wherein the projections extend away from the ground.

16. The method of claim 13, further comprising implementing the steps of positioning, adding, and compacting during earthwork or pavement construction.

17. A method of strengthening and stiffening a particulate material, the method comprising:

positioning the reinforcement system of claim 1, 5, or 10 on the ground;

adding the aggregate to the reinforcement system; and compacting the aggregate.

18. The method of claim 17, wherein the projections extend towards the ground.

19. The method of claim 17, wherein the projections extend away from the ground.

20. The method of claim 17, further comprising implementing the steps of positioning, adding, and compacting during earthwork or pavement construction.

* * * * *